US006782604B2

(12) United States Patent
Kojima et al.

(10) Patent No.: US 6,782,604 B2
(45) **Date of Patent: *Aug. 31, 2004**

(54) METHOD OF MANUFACTURING A CHIP PTC THERMISTOR

(75) Inventors: Junji Kojima, Hirakata (JP); Kohichi Morimoto, Sakai (JP); Takashi Ikeda, Osaka (JP); Toshiyuki Iwao, Moriguchi (JP)

(73) Assignee: Matsushita Electric Industrial Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/462,439

(22) PCT Filed: Apr. 30, 1998

(86) PCT No.: PCT/JP98/01969

§ 371 (c)(1),
(2), (4) Date: Feb. 16, 2000

(87) PCT Pub. No.: WO99/03113

PCT Pub. Date: Jan. 21, 1999

(65) Prior Publication Data

US 2002/0021203 A1 Feb. 21, 2002

(30) Foreign Application Priority Data

Jul. 7, 1997 (JP) ..... 9-181039

(51) Int. Cl.[7] ..... H01C 7/02; H01C 7/04

(52) U.S. Cl. ..... 29/612; 29/610.1; 29/611; 338/22 R; 338/225 D; 338/328; 338/332

(58) Field of Search ..... 338/22 R, 22 SD, 338/332, 328; 29/610, 611, 612

(56) References Cited

U.S. PATENT DOCUMENTS

| | | | | | |
|---|---|---|---|---|---|
| 4,143,343 | A | * | 3/1979 | Inoue et al. | 333/194 |
| 4,426,633 | A | * | 1/1984 | Taylor | 338/25 |
| 4,486,738 | A | * | 12/1984 | Sadlo et al. | 338/320 |
| 4,549,161 | A | * | 10/1985 | McTavish et al. | 338/22 R |
| H415 | H | * | 1/1988 | Newnham | 338/22 R |

(List continued on next page.)

FOREIGN PATENT DOCUMENTS

| | | | |
|---|---|---|---|
| JP | 61-10203 | * | 1/1986 |
| JP | 61-111502 | | 5/1986 |
| JP | 04346409 | * | 12/1992 |

(List continued on next page.)

*Primary Examiner*—Peter Vo
*Assistant Examiner*—Paul D Kim
(74) *Attorney, Agent, or Firm*—Parkhurst & Wendel, L.L.P.

(57) ABSTRACT

Chip PTC thermistors that can easily be inspected the soldered portions after it is mounted on a printed circuit board and that can be used in a flow soldering process, and methods of making same. A chip PTC thermistor of the present invention includes: a first main electrode and a first sub-electrode on first surface of a cuboidal form conductive polymer having the PTC characteristics, a second main electrode and a second sub-electrode on a second surface opposite the first surface of the conductive polymer. Between the first sub-electrode and the second sub-electrode, and between the first sub-electrode and the second main electrode are electrically connecting with a first side electrode and a second side electrode, respectively.

2 Claims, 15 Drawing Sheets

U.S. PATENT DOCUMENTS 4,766,409 A * 8/1988 Mandai ..... 338/22 R
4,882,466 A * 11/1989 Friel ..... 219/219
4,959,505 A * 9/1990 Ott ..... 338/22 R
4,959,632 A * 9/1990 Uchida ..... 338/22 R
5,077,889 A * 1/1992 Matsuda et al. ..... 29/612
5,228,188 A * 7/1993 Badihi et al. ..... 29/623
5,245,309 A * 9/1993 Kawase ..... 338/22 R
5,348,761 A * 9/1994 Mitter et al. ..... 427/101
5,488,348 A * 1/1996 Asida ..... 338/22 R
5,493,266 A * 2/1996 Sasaki et al. ..... 338/22 R
5,552,757 A * 9/1996 Blecha et al. ..... 337/297
5,804,797 A * 9/1998 Kaimoto et al. ..... 219/505
5,852,397 A * 12/1998 Chan et al. ..... 338/22 R
5,855,849 A * 1/1999 Li et al. ..... 422/88
5,884,391 A * 3/1999 McGuire et al. ..... 338/22 R
5,929,741 A * 7/1999 Nishimura et al. ..... 337/290
5,963,416 A * 10/1999 Honda et al. ..... 361/306.1
6,023,403 A * 2/2000 McGuire et al. ..... 361/106
6,151,771 A * 11/2000 Tzeng et al. ..... 29/610.1
6,292,088 B1 * 9/2001 Zhang et al. ..... 338/22 R

FOREIGN PATENT DOCUMENTS

| | | |
|---|---|---|
| JP | 5-47446 | 12/1993 |
| JP | 7-509347 | 10/1995 |
| JP | 9-503097 | 3/1997 |
| WO | WO 94/01876 | 1/1994 |
| WO | WO 95/08176 | 3/1995 |

* cited by examiner

METHOD OF MANUFACTURING A CHIP PTC THERMISTOR

TECHNICAL FIELD

The present invention relates to a chip PTC thermistor which uses a conductive polymer having a positive temperature coefficient (hereinafter referred to as "PTC"), and methods for manufacturing the same.

BACKGROUND ART

PTC thermistors have been used as the components to protect a device against an overcurrent. Exposure to an overcurrent in an electric circuit causes the conductive polymer having the PTC characteristics used in a PTC thermistor to heat up and expand by self heating. The thermal expansion increases resistance of the conductive polymer sheet in the PTC thermistor, and thus reduces the current to a safer level.

A conventional chip PTC thermistor is described below.

One known chip PTC thermistor is disclosed in Japanese Laid-open Patent No. H9-503097. The chip PTC thermistor is formed of a resistive material having the PTC characteristics, the chip thermistor having a first surface and a second surface. The chip thermistor comprises a PTC resistor element that specifies a space between the first surface and the second surface, a lateral conductive member provided within said space through the first surface and the second surface of PTC element, the conductive member being fixed to said PTC element, and a first layered conductive member connected physically and electrically to the lateral conductive member. FIG. 14A shows a cross sectional view of the conventional chip PTC thermistor, and FIG. 14B is the plan view. In FIGS. 14A and B, a resistor body 61 is formed of a conductive polymer having PTC characteristics, electrodes 62*a*, 62*b*, 62*c*, 62*d* are formed of a metal foil, conductive members 64*a*, 64*b* are formed inside the openings 63*a*, 63*b* by plating, and electrically couple the electrode 62*a* with 62*d*, and the electrode 62*b* with 62*c* respectively.

A method for manufacturing the conventional chip PTC thermistor is described below. FIGS. 15A–15D, and FIGS. 16A–16C illustrate the process steps for manufacturing the conventional chip PTC thermistor.

Polyethylene and conductive carbon particles are mixed to form a sheet 71 shown in FIG. 15A. The sheet 71 is sandwiched by two sheets of a metal foil 72, as shown in FIG. 15B, and these are heat pressed together to be integrated into a sheet 73 as shown in FIG. 15C. After undergoing electron beam irradiation, the integrated sheet 73 is provided with through holes 74 in a regular pattern arrangement as shown in FIG. 15D, and then a metal film 75 is formed by plating to cover the inner surface of the through hole 74 and the metal foil 72, as shown in FIG. 16A. Then, as shown in FIG. 16B, an etched slit 76 is formed in the metal foil through a photo-lithographic process. And then, it is cut off along a longitudinal cut line 77 and a lateral cut line 78 to be separated into piece chips to obtain the conventional chip PTC thermistor 79 as shown in FIG. 16C.

In the conventional chip PTC thermistor of the above configuration, however, the two electrodes 62*a* and 62*b*, or 62*c* and 62*d*, which are to be connected with a printed circuit board when the chip thermistors are mounted thereon, are disposed on only one surface of the chip thermistor (ref. FIG. 14A). As a result, when the chip thermistors are mounted on a printed circuit board and reflow-soldered, solder fillets formed by the soldering are not visible from above because they are shadowed by the chip thermistors. Therefore, it is difficult to make sure of the state of soldering by visually inspecting the soldered portion. Furthermore, because the electrodes of the chip thermistors are not disposed at their sides, the flow soldering process is not applicable.

Furthermore, in the above described conventional manufacturing method, dislocation of the cut lines in relation to the location of a through hole is not avoidable because of dispersions in the accuracy of the sheet aligning and the cutting operations. This readily leads to a variation in the area of coupling between the conductive member formed within the through hole and the top/bottom electrodes. FIG. 17A shows a state wherein no dislocation exists between the through hole and the cut line, while FIG. 17B shows a state where there is a dislocation. In FIGS. 17A and 17B, numeral 81 denotes a through hole, 82 is a cut line, 83 is an electrode, 84 is an etched slit. In a case where a part of one through hole 81, among the through holes located at both sides of a cut line, is cut as a result of the above described dislocation, as shown in FIG. 17B, the area at a contact section 85 making contact between the conductive member disposed within the through hole and the top/bottom electrodes becomes smaller, as compared with a case where there is no such dislocation. The case caused by a dislocated cut line is illustrated in FIG. 17C. A problem with the reduced contact area between the conductive member and the top/bottom electrodes is that the junction between the conductive member and the top/bottom electrodes is easily cracked due to stress caused thereon by repetitive expansion and shrinkage of the conductive polymer.

The present invention addresses the above problems and aims to provide a chip PTC thermistor, as well as a method of manufacturing the same, wherein the soldered portion can be inspected easily visually after the chip thermistors are mounted on a printed circuit board, and the chip PTC thermistor can be soldered by flow soldering. Furthermore, the coupling between the conductive member and the electrodes has only a small dispersion in the strength of connection against the stress that caused as a result of expansion and shrinkage of the conductive polymer.

DISCLOSURE OF THE INVENTION

A chip PTC thermistor of the present invention comprises:

- a cuboidal form conductive polymer having the PTC characteristics;
- a first main electrode disposed on a first surface of the conductive polymer;
- a first sub-electrode disposed on the same surface as the main electrode, yet being independent from the first main electrode;
- a second main electrode disposed on a second surface opposite the first surface of the conductive polymer;
- a second sub-electrode disposed on the same surface as the second main electrode, yet being independent from the second main electrode;
- a first side electrode disposed covering at least the entire surface of one of the side surfaces of the conductive polymer, which side electrode is electrically connected with the first main electrode and the second sub-electrode; and
- a second side electrode disposed covering at least the entire surface of the other side surface opposing the one side surface of the conductive polymer, which side electrode is electrically connected with the first sub-electrode and the second main electrode.

In a method for manufacturing the chip PTC thermistors of the present invention, a conductive polymer having the PTC characteristics is sandwiched from the top and the bottom by a patterned metal foil and these are integrated by heat pressing into a sheet form, the integrated sheet is provided with openings, the integrated sheet having the openings is coated on the top and the bottom surfaces with a protective coating, a side electrode is formed at the side of the sheet having the protective coating and the openings, and the sheet provided with the side electrodes and the openings is divided into pieces.

With the chip PTC thermistors as configured above, solder fillet can be formed at the side of thermistor chips mounted on a printed circuit board because the side electrode is provided covering at least the entire side surface of the two side surfaces of the conductive polymer. Thus the chip PTC thermistors provide an advantage that the state of soldering of the soldered portions can be confirmed easily by visual inspecting after the chip thermistors are mounted on a printed circuit board a further advantage of the chip PTC thermistor is that they can be used in a flow soldering process.

In a method for manufacturing the chip PTC thermistors, wherein the conductive polymer having the PTC characteristics and the patterned metal foils are heat-pressed to be integrated into a sheet form and the sheet is provided with openings and then the side electrode is formed thereon by plating or other means, the shape of the end surfaces of the openings does not vary even if there was a slight displacement in the location of the openings relative to the pattern of metal foil due to a tolerance in the accuracy during the process for forming the openings; the shape remains straight lined.

Therefore, the side electrode formed on the end face by plating, or like method, always has a certain stable junction area with the first and the second main electrodes. Thus, the strength of coupling at the junction area between the side electrode and the first or the second main electrode, against stress due to expansion and shrinkage of conductive polymer, will have only small dispersion.

DETAILED DESCRIPTION OF THE INVENTION

First Embodiment

A chip PTC thermistor in a first exemplary embodiment of the present invention is described with reference to the drawings.

Figure 1A:
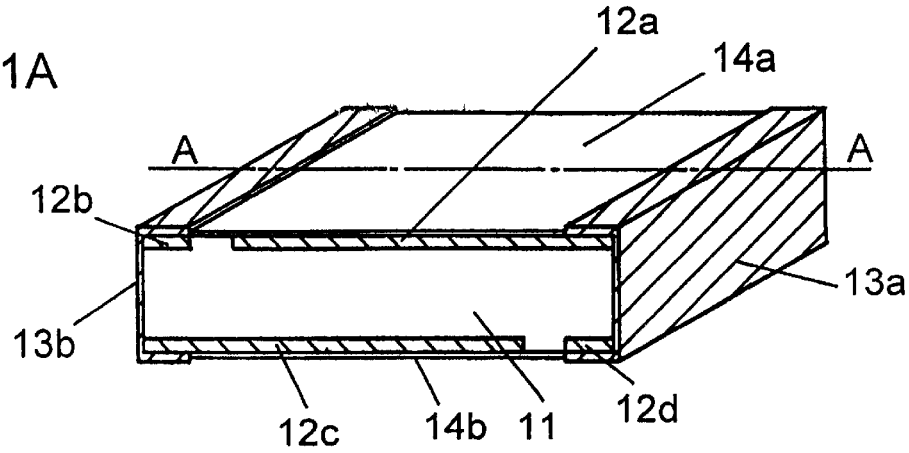
FIG. 1A is a perspective view of a chip PTC thermistor in accordance with a first exemplary embodiment of the present invention.
Figure 1B:
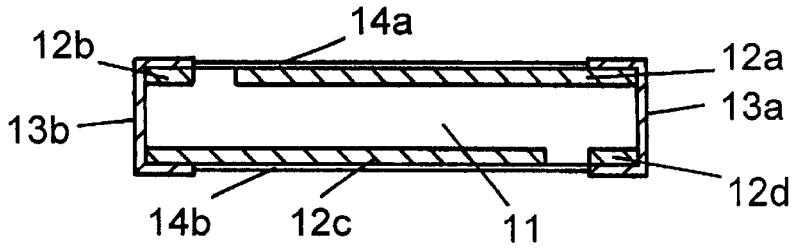
FIG. 1B is a sectional view of the chip PTC thermistor along the line 200—200 of FIG. 1A.

FIG. 1A is a perspective view of the chip PTC thermistor in the first exemplary embodiment of the present invention. FIG. 1B is a sectional view taken along the line A—A of FIG. 1.

In FIGS. 1A and 1B, a cuboidal form conductive polymer 11 having the PTC characteristics is made of a mixed compound of high density polyethylene, i.e. a crystalline polymer, and carbon black, i.e. conductive particles.

First main electrode 12*a* is disposed on a first surface of the conductive polymer 11. First sub-electrode 12*b* is disposed on the same surface as the first main electrode 12*a*, yet being independent from the first main electrode 12*a*.

Second main electrode 12*c* is disposed on a second surface, which is opposite to the first surface of the conductive polymer 11. Second sub-electrode 12*d* is disposed on the same surface as the second main electrode 12*c*, yet being independent from the second main electrode 12*c*.

Each of these main and sub-electrodes is made of electrolytic copper foil.

First side electrode 13*a* is formed of a plated nickel covering the entire surface of one of the side ends of the conductive polymer 11, and is electrically connected with the first main electrode 12*a* and the second sub-electrode 12*d*.

Second side electrode 13*b* is formed of a plated nickel covering the entire surface of the other side end opposed to the first side electrode 13*a* of the conductive polymer 11, and is electrically connected with the second main electrode 12*c* and the first sub-electrode 12*b*.

First and second protective layers 14*a*, 14*b* are formed of an epoxy-modified acrylic resin.

When a side electrode is formed by plating, since adhesion between the conductive polymer and a plated layer may not be sufficiently strong, the side electrode may peel from the conductive polymer. So, the sub-electrode, together with the main electrode, are expected to function as the supporting body for the plated side electrode, for ensuring good adhesion of the side electrode onto the conductive polymer.

Next, a method for manufacturing a chip PTC thermistor in a first exemplary embodiment as configured above is described with reference to the drawings.

FIGS. 2A–2C and FIGS. 3A–E illustrate process of a method of manufacturing the chip PTC thermistors in accordance with the first embodiment.

Figure 2A:
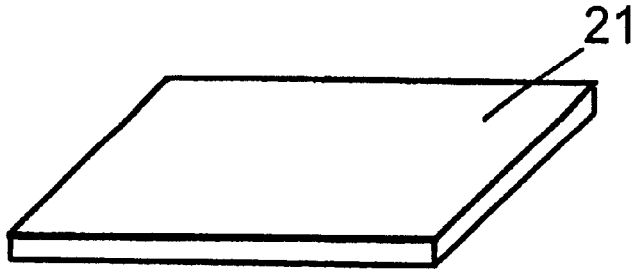
FIGS. 2A–2C illustrate a process for manufacturing the chip PTC thermistor of embodiment 1.

In the first place, 49 wt. % of high density polyethylene of 70–90% crystallinity, 50 wt. % of furnace black having average particle diameter of 58 nm and specific surface area of 38 $m^2/g$, and 1 wt. % of antioxidant are mixed and kneaded for about 20 minutes using two roll mills heated at about 150° C., to fabricate a conductive polymer sheet 21 of about 0.3 mm thick, as shown in FIG. 2A.

Figure 2B:
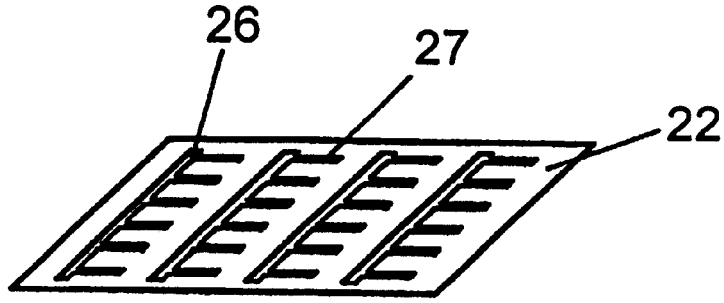

Then, as shown in FIG. 2B, an electrolytic copper foil is patterned to have comb shape slits using a die press to provide electrode 22. A slit 26 is made for forming a gap between a main electrode and a sub-electrode after a sheet is divided into pieces in a later process step. A slit 27 is provided for reducing the cut area of the electrolytic copper foil in the process of dividing a sheet into pieces.

The slit 27 contributes to eliminate generation of burr of the electrolytic copper foil in the dividing process step, as well as to eliminate exposure of the cut face of the electrolytic copper foil in the side surface of a divided chip PTC thermistor. The exposure of a cut face may invite oxidation of the electrolytic copper foil, and short-circuiting by solder when the chip PTC thermistor is mounted on a printed circuit board.

Figure 2C:
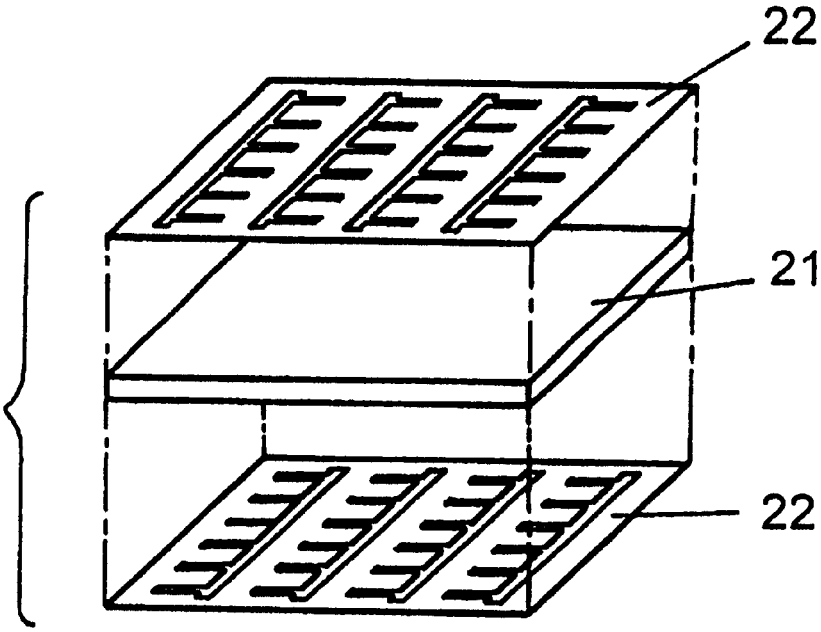
Figure 3A:
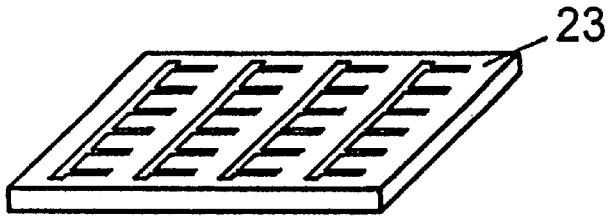
FIGS. 3A–3E illustrate a process for manufacturing the chip PTC thermistor of embodiment 1.

And then, as shown in FIGS. 2C and 3A, the conductive polymer sheet 21 is sandwiched from the top and the bottom by the electrode 22, and these are heat pressed at about 175° C., in a vacuum of about 20 torr, and under pressure of about 50 $kg/cm^2$ for about 1 minute using a vacuum heat press to make an integrated sheet 23. Then, an about 40 Mrad electron beam is irradiated onto the sheet in electron beam irradiation equipment to crosslink the high density polyethylene.

Figure 3B:
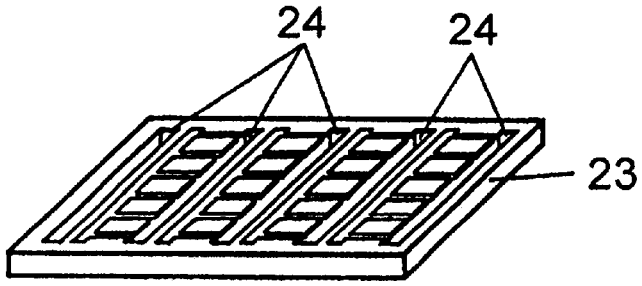

As shown in FIG. 3B, oblong openings 24 (slits) are provided at regular intervals so that a space corresponding to the length of a certain chip PTC thermistor is preserved, using a die press or a dicing machine.

Figure 4A:
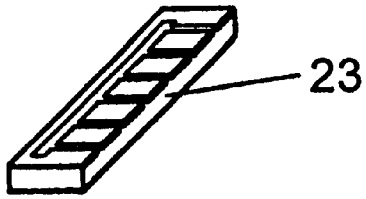
FIGS. 4A and 4B show examples of a strip form and a comb shape.
Figure 4B:
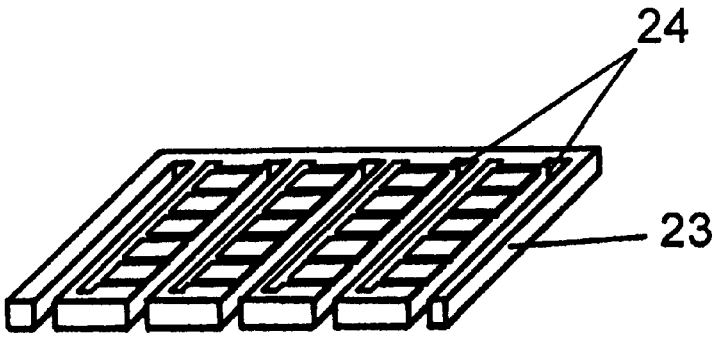

Process of providing the opening may either be the formation of strips or the formation into a comb shape, as shown in FIGS. 4A and 4B.

Figure 3C:
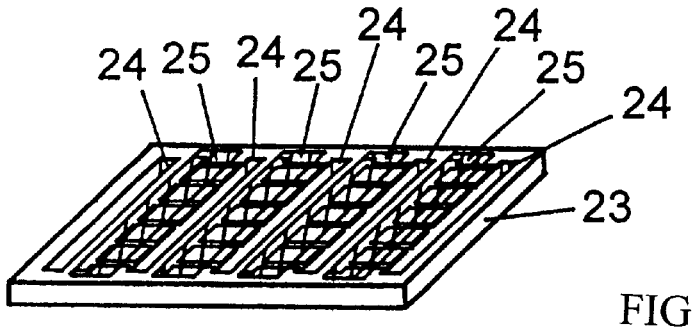

Protective coating 25 is formed, as shown in FIG. 3C, on the top and the bottom surfaces of the sheet 23 having the openings 24, except the area at the vicinity of the openings 24, by screen printing an acrylic, or an epoxy-modified acrylic UV curing resin, followed by curing in an UV curing oven.

Figure 3D:
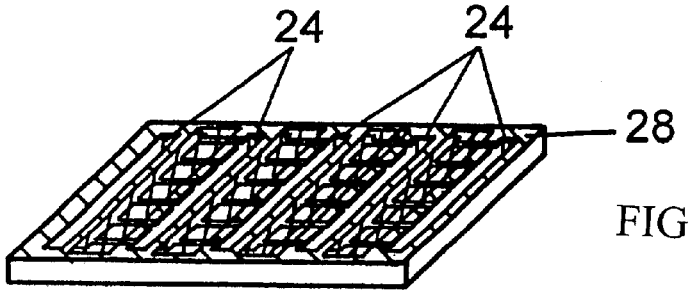

Then, as shown in FIG. 3D, a 10–20 $\mu$m thick nickel film 28 is plated on the sheet 23 in an area on which there is no protective coating 25, including the inner wall surface of the opening 24, in a Watts nickel bath for about 30 minutes at a current density of about $4A/dm^2$.

Figure 3E:
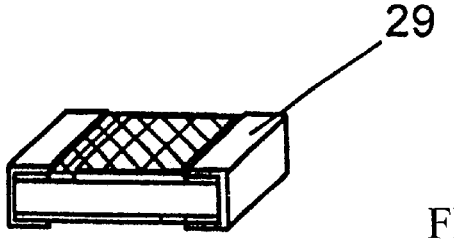

The sheet 23 is divided into pieces by a die press or a dicing machine to obtain a chip PTC thermistor 29 of the present invention as shown in FIG. 3E. The chip PTC thermistors of the same configuration may be obtained also by first integrating unpatterned metal foil with conductive polymer sheet through heat-pressing and then patterning the metal foil using the photo-lithography and etching process.

Now in the following, the first embodiment of the present invention is described further in detail with respect to the structure.

After chip-type electronic components are mounted on a printed circuit board by reflow soldering, it is a common practice to inspect the soldered portion visually since uneven printing of cream solder or an insufficient solder quantity invites a poor contact, or deteriorates the reliability of solder during the heat cycles.

With the chip PTC thermistors of the present invention, the solder fillet is formed at the side of chip thermistors soldered on a printed circuit board. The solder fillet is positioned outside of a chip thermistor. Therefore, the soldered portion can be easily inspected.

Figure 1C:
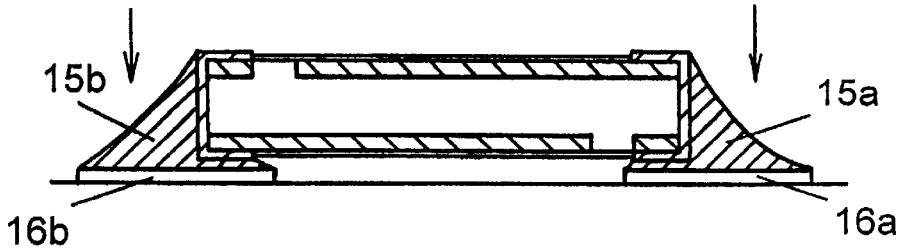
FIG. 1C is a sectional view of the chip PTC thermistor mounted on a printed circuit board.

FIG. 1C is a sectional view of the chip PTC thermistor being mounted on a printed circuit board. Numerals 16*a*, 16*b* denote the lands of the printed circuit board. As indicated with an arrow mark in FIG. 1C, the fillets 15*a*, 15*b* can easily be observed from above.

Further, it has been confirmed that the chip PTC thermistors of the present invention can be used in the flow soldering process.

In general, the adhesion between the plated film forming the side electrode and the conductive polymer is weak. In the first embodiment of the present invention, however, the plated film is supported by the main electrode and the sub-electrode formed, respectively, on the top and bottom surfaces of the conductive polymer. Thus the side electrode, which has been formed by plating, is well secured with respect to adhesion to the conductive polymer. The above described structure of the present invention is effective enough to avoid peeling of the side electrode off the conductive polymer.

In the prior art manufacturing method, a cut line dislocated relative to the location of through hole may result in a reduced area of coupling between the conductor within the through hole and the top/bottom electrodes.

However, in the manufacturing method of the first embodiment, where a conductive polymer having the PTC characteristics and metal foils are integrated into a sheet form by heat-pressing, and the sheet is provided with openings and then a conductive film is formed therein by plating, the area of coupling between the plated film and the top/bottom electrodes remains unchanged and constant despite a possible dislocation. The strength of coupling between the plated film and the top/bottom electrodes is not reduced; and cracks will not be generated at the coupling portion by the stress due to repetitive expansion and shrinkage of the conductive polymer.

Furthermore, in the process of the first embodiment, only the cutting in lateral direction completes the dividing into chip thermistor pieces. There is no need of longitudinal cutting operation for the dividing.

In the prior art manufacturing method, where a plated layer is formed within through holes provided by drilling or other methods, the number of the through holes to be drilled is at least more than the number of chip thermistor pieces yielded from of a sheet. Thus it takes a long time to drill all the through holes. In addition, the heat generated due to friction during drilling causes melting of the conductive polymer, which results in a rough wall surface of the through holes. Consequently, a layer plated thereon becomes uneven.

Under the manufacturing method in accordance with the first embodiment, however, the openings are provided at once in a strip shape using a die press, dicing machine, or the like. This contributes to higher productivity. Furthermore, since there is no melting in the conductive polymer, the wall surfaces of the openings are relatively smooth which contributes to provide a plated layer of even thickness.

Furthermore, in the conventional manufacturing method, plating solution cannot circulate well inside the through holes, and concentration of metal ions in the plating liquid becomes unstable. This disturbs formation of a plated layer at even thickness. If a plated layer is formed in uneven thickness, the concentration of stress due to repetitive expansion and shrinkage of the conductive polymer responding to overcurrent in a chip thermistor at work will lead to breakage of the plated layer.

Under the manufacturing method in the first embodiment, however, the portion on which a plated layer is to be formed is exposed to an open space, and plating solution can circulate freely. Therefore, the concentration of metal ion can be maintained stable. This contributes to formation of a layer of even thickness.

Still further, in the conventional manufacturing method, foreign items contained in the plating solution may lodge in the through holes, a burr, or if the through hole has been provided by drilling, may easily catch such foreign items. This may create a void in the plating film.

However, under the manufacturing method for the first embodiment, the portion on which the side electrode is to be formed is exposed to a sufficiently open space, so such foreign items, if any, contained in plating solution may not stay on the portion. The side electrodes of the present invention are open to the outside and easily inspected from the outside. The plating current is sufficiently lower than a level for the conductive polymer to start its PTC operation, so the conductive polymer will never be put into operation.

Furthermore, in the manufacturing method of the first embodiment, an integrated sheet provided with the openings is plated for formation of the side electrodes, and then the sheet is divided into pieces. Therefore, two other side faces of the thermistor than the two side surfaces on which the side electrode has been formed can not have a plated layer. In other manufacturing methods, where, for example, completed chips are barrel-plated after the dividing process step, the conductive polymer, having a conductive side face, will have a chance to be plated on all of the four side-faces. This of course leads to short circuiting between the first main electrode and the second main electrode.

Second Embodiment

A chip PTC thermistor in a second exemplary embodiment of the present invention is described, referring to the drawings.

Figure 5:
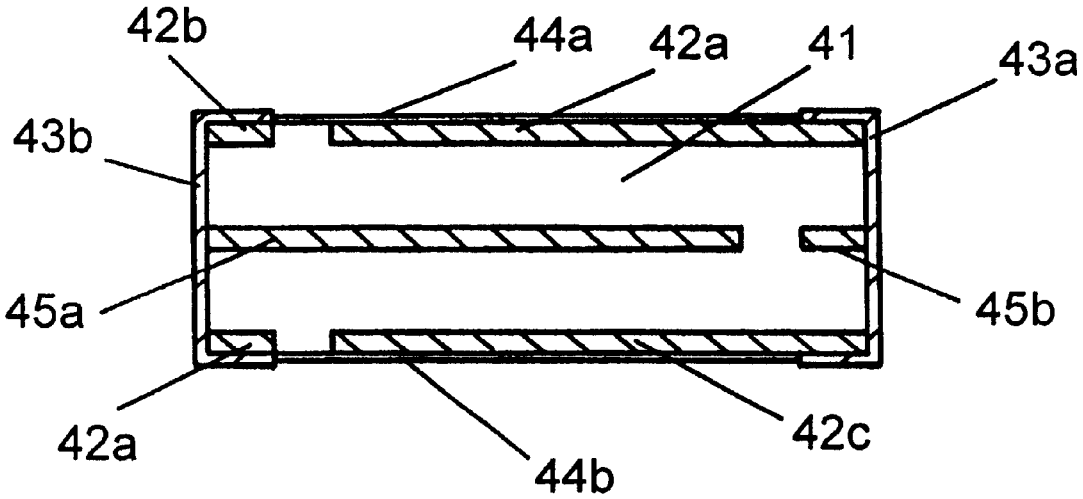
FIG. 5 is a sectional view of a chip PTC thermistor in accordance with a second exemplary embodiment of the present invention.

FIG. 5 is a sectional view of the chip PTC thermistor of the second exemplary embodiment.

In FIG. 5, a cuboidal form conductive polymer 41 having the PTC characteristics is made of a mixed compound of high density polyethylene, i.e. a crystalline polymer, and carbon black, i.e. conductive particles.

First main electrode 42*a* is disposed on a first surface of the conductive polymer 41. First sub-electrode 42*b* is disposed on the same surface as the first main electrode 42*a*, yet being independent from the first main electrode 42*a*. Second main electrode 42*c* is disposed on a second surface, which is opposite the first surface of the conductive polymer 41. Second sub-electrode 42*d* is disposed on the same surface as the second main electrode 42*c*, yet is independent from the second main electrode 42*c*.

Each of these main and sub-electrodes is made of electrolytic copper foil.

First side electrode 43*a* is formed by nickel plating covering the entire surface of one of the side ends of the conductive polymer 41, and is electrically connected with the first main electrode 42*a* and the second main electrode 42*c*.

Second side electrode 43*b* is formed by nickel plating covering the entire surface of the other side end opposing the first side electrode 43*a* of the conductive polymer 41, and is electrically connected with the first sub-electrode 42*b* and the second sub-electrode 42*d*.

First and second protective coating layers 44*a*, 44*b* are made of an epoxy-modified acrylic resin.

Inner main electrode 45*a* is disposed within the conductive polymer 41, in parallel with the first main electrode 42*a* and the second main electrode 42*c*, and is electrically connected with the second side electrode 43*b*. Inner sub-electrode 45*b* is disposed at the same plane as the inner main electrode 45*a*, yet being independent from said inner main electrode 45*a*, and is electrically connected with the first side electrode 43*a*.

A method for manufacturing the chip PTC thermistors in a second exemplary embodiment is described next with reference to the drawings.

Figure 6A:
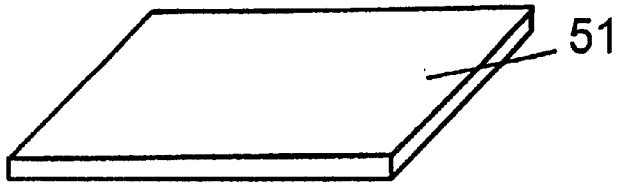
FIGS. 6A–6C illustrate a process for manufacturing the chip PTC thermistor of the second embodiment.
Figure 6B:
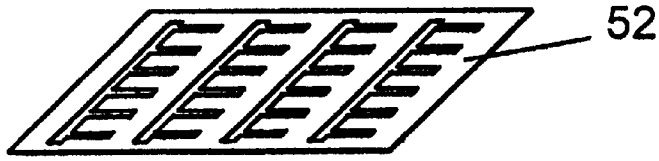

FIGS. 6A–6C and FIG. 7 illustrate a method of manufacturing the chip PTC thermistors of a second embodiment of the present invention. In the same way as in the first embodiment, a conductive polymer sheet 51 as shown in FIG. 6A, is provided, and an electrolytic copper foil is patterned by die press to provide electrode 52 as shown in FIG. 6B.

The thickness of the electrolytic copper foil for forming the inner electrode should be not less than 35 $\mu$m, preferably thicker than 70 $\mu$m, so it is not broken by expansion of the conductive polymer during formation of a laminated body, to be described later, by heat pressing.

Figure 6C:
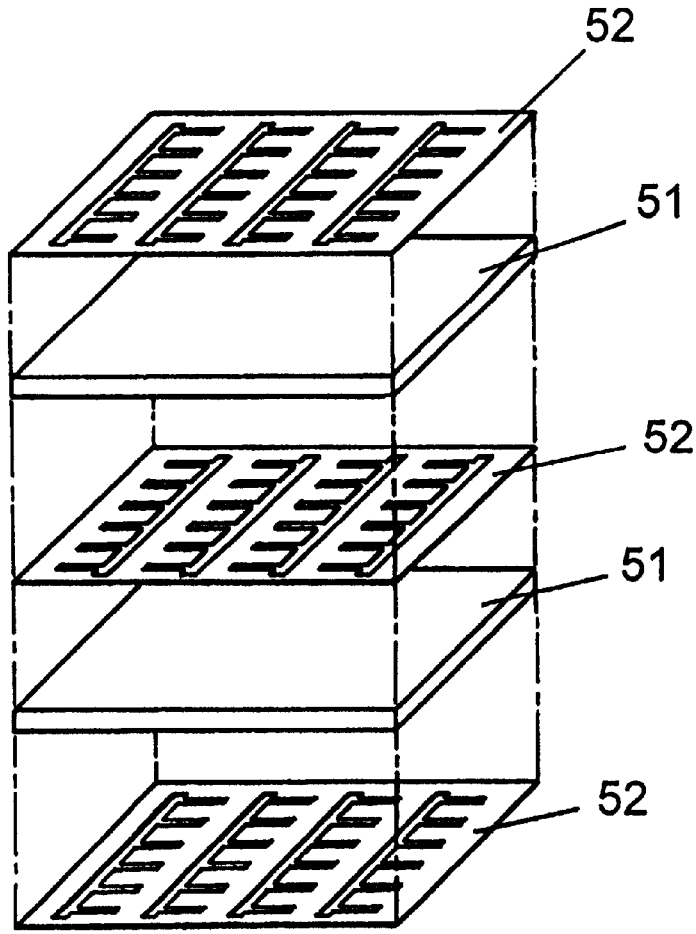
Figure 7:
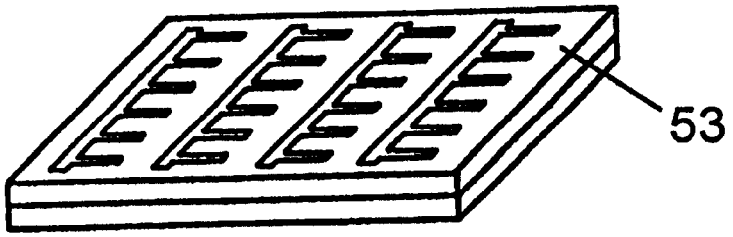
FIG. 7 illustrates a process for manufacturing the chip PTC thermistor of the second embodiment.

Next, as shown in FIG. 6C, the conductive polymer 51 and the electrode 52 are alternately stacked to be integrated into a sheet 53 of FIG. 7 by heat pressing. The three sheets of electrode 52, shown in FIG. 6C, may have a same pattern, which means that these sheets may be provided using only one die pattern. This is an economic advantage.

Thereafter, the same manufacturing process steps as in the first embodiment have been followed to provide the chip PTC thermistor in the second embodiment of the present invention.

A laminated body may also be formed using unpatterned metal foils for the outermost layers, while other foils are those patterned by die pressing, and integrating the metal foils and conductive polymer together by heat pressing, and then patterning the outermost metal foils using the photolithography and etching process. A chip PTC thermistor of the same configuration may be produced from the laminated body thus produced, by following the same process steps as those in the first embodiment.

In the PTC thermistor chips of the second embodiment the overlapping area of opposing electrodes has been increased by alternately laminating the layers of conductive polymer and metal foil, without making the overall dimensions of the thermistor greater. This configuration enables lowering the internal resistance of a chip thermistor. As a result, a chip PTC thermistor that allows a greater current in a compact body is obtained.

In a practical example, a chip PTC thermistor of single layered conductive polymer, dimensions 3.2 mm×4.5 mm, has an overlapping area between the first and the second main electrodes (area of the opposing electrodes) of 9 $mm^2$, resistance of approximately 150 mohms; whereas that of the double layered exhibited a low resistance of approximately 80 m ohms with the area of opposing electrodes 18 $mm^2$, while maintaining the same plane dimensions of 3.2 mm×4.5 mm. In the following, a more exemplary embodiment of the present invention is described, in which the resistance is further reduced.

Third Embodiment

Figure 8:
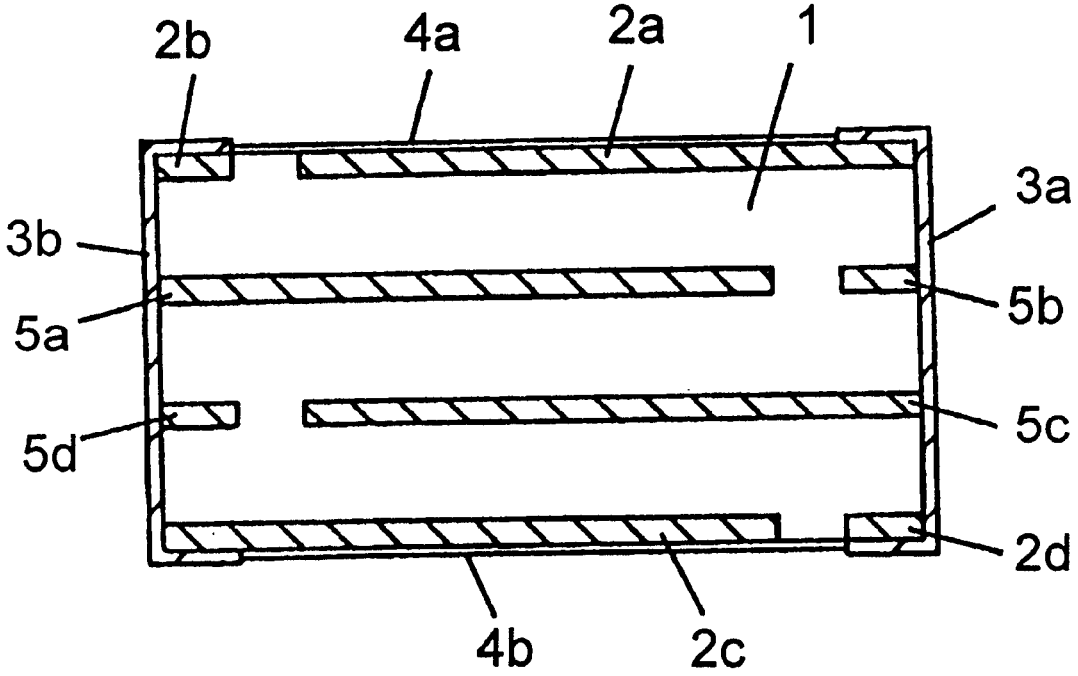
FIG. 8 is a sectional view of a chip PTC thermistor in accordance with a third exemplary embodiment of the present invention.

FIG. 8 illustrates a sectional view of a chip PTC thermistor in a third exemplary embodiment of the present invention.

In FIG. 8, a cuboidal form conductive polymer 1 having the PTC characteristics is made of a mixed compound of high density polyethylene, i.e. a crystalline polymer, and carbon black, i.e. conductive particles.

First main electrode 2*a* is disposed on a first surface of the conductive polymer 1. First sub-electrode 2*b* is disposed on the same surface as the first main electrode 2*a*, yet is independent from the first main electrode 2*a*.

Second main electrode 2*c* is disposed on a second surface, which is opposite the first surface, of the conductive polymer 1. Second sub-electrode 2*d* is disposed on the same surface as the second main electrode 2*c*, yet is independent from the second main electrode 2*c*.

Each of these main and sub-electrodes is made of electrolytic copper foil.

First side electrode 3*a* is formed by nickel plating covering the entire surface of one of the side ends of the conductive polymer 1, and is electrically connected with the first main electrode 2*a* and the second sub-electrode 2*d*.

Second side electrode 3*b* is formed by nickel plating covering the entire surface of the other side end opposite the first side electrode 3*a* of the conductive polymer 1, and is electrically connected with the first sub-electrode 2*b* and the second main electrode 2*c*.

First and second protective coating layers 4*a*, 4*b* are made of an epoxy-modified acrylic resin.

First inner main electrode 5*a* is located within the conductive polymer 1, in parallel with the first main electrode 2*a* and the second main electrode 2*c*, and is electrically connected with the second side electrode 3*b*. First inner sub-electrode 5*b* is located at the same plane as the first inner main electrode 5*a*, yet is independent from the first inner main electrode 5*a*, and is electrically connected with the first side electrode 3*a*.

Second inner main electrode 5*c* is located within the conductive polymer 1, in parallel with the first main electrode 2*a* and the second main electrode 2*c*, and is electrically connected with the first side electrode 3*a*. Second inner sub-electrode 5*d* is located at the same plane as the second inner main electrode 5*c*, yet is independent from the second inner main electrode 5*c*, and is electrically connected with the second side electrode 3*b*.

In the chip PTC thermistor configured as above, where the conductive polymer 1 of 3.2 mm×4.5 mm size has been stacked in three layers and the resistances between the first main electrode 2*a* and the first inner main electrode 5*a*, that between the first inner main electrode 5*a* and the second inner main electrode 5*c* and that between the second inner main electrode 5*c* and the second main electrode 2*c* have been connected in parallel, the overlapping area of opposing electrodes reached 27 $mm^2$ in real terms and the resistance has been reduced to as low as approximately 50 mohms. Thus a extremely low resistance chip PTC thermistor is obtained.

A method for manufacturing the chip PTC thermistors in a third exemplary embodiment is described next with reference to the drawings.

FIGS. 9A–9D and FIGS. 10A–10B illustrate a method of manufacturing the chip thermistors having three conductive polymer layers.

Figure 9A:
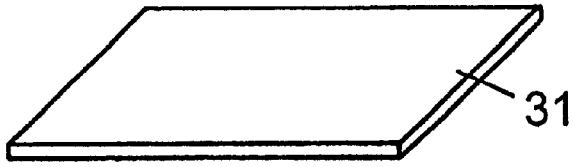
FIGS. 9A–9D illustrate a process for manufacturing the chip PTC thermistor of the third embodiment.
Figure 9B:
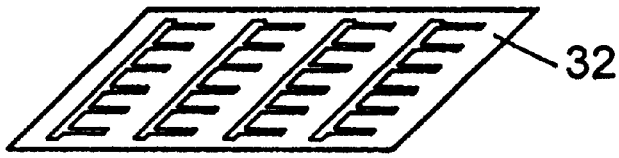

In the same way as in the first embodiment, a conductive polymer sheet 31, shown in FIG. 9A, is provided. An electrolytic copper foil is patterned by die press to provide electrode 32 as shown in FIG. 9B. Like the chip thermistor having two conductive polymer layers, thickness of the electrolytic copper foil for the inner electrode should be not less than 35 $\mu$m, preferably thicker than 70 $\mu$m, so it is not broken by expansion of the conductive polymer during formation of a laminated body by heat pressing.

Figure 9C:
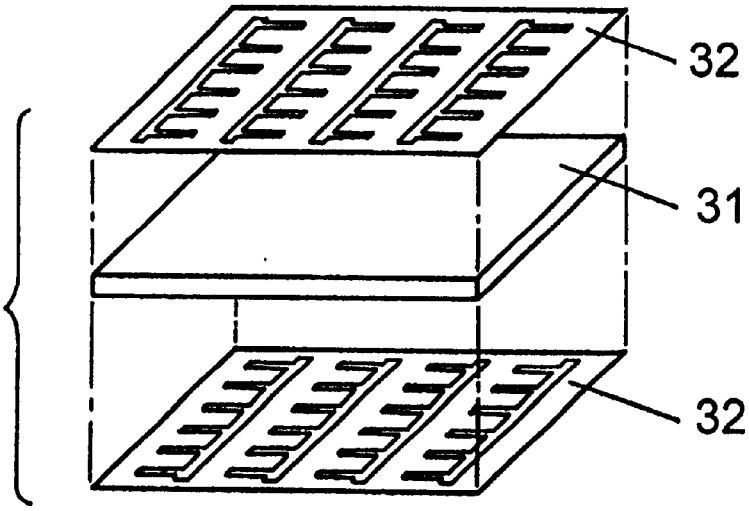
Figure 9D:
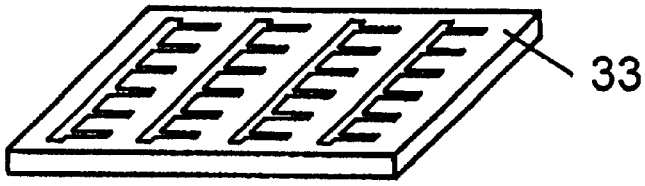
Figure 10A:
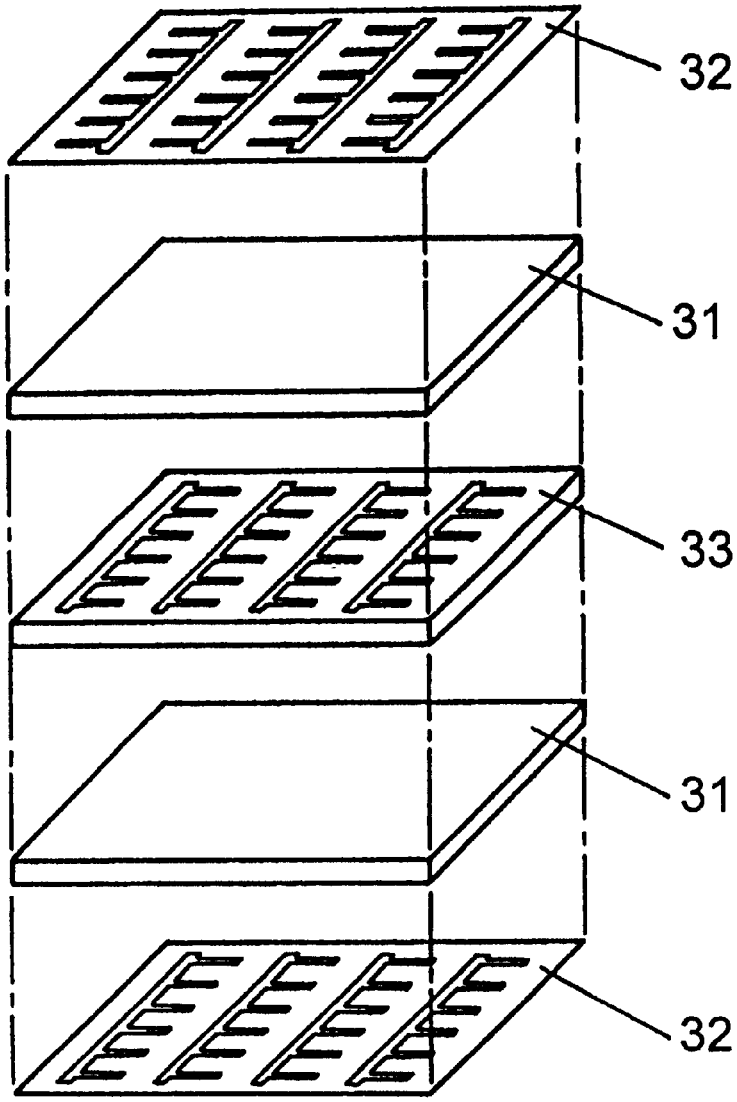
FIGS. 10A and 10B illustrate a process for manufacturing the chip PTC thermistor of the third embodiment.
Figure 10B:
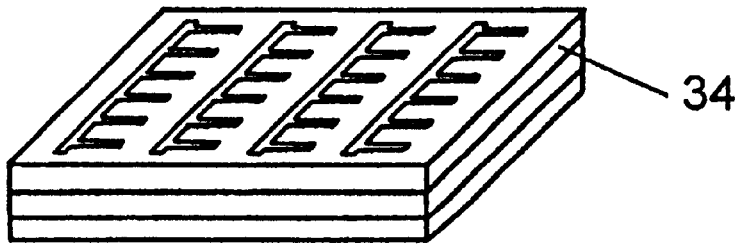

Next, as shown in FIGS. 9C and 9D, the conductive polymer sheet 31 is sandwiched by two electrodes 32 to be integrated into a first sheet 33, shown in FIG. 9D, by heat pressing. And, then, as shown in FIG. 10A, two conductive polymer sheets 31 and two electrodes 32 are stacked on both surfaces of the first sheet 33, so that respective electrodes 32 are placed on the outermost surface, which are to be integrated into a second sheet 34 of FIG. 10B by heat pressing.

Thereafter, the same manufacturing process steps as in the first embodiment are followed to obtain the chip PTC thermistors having three conductive polymer layers.

The reason why the heat-pressing operation is conducted separately in two steps is for avoiding unevenness in the thickness of conductive polymer sheets. If the heat-pressing is conducted in one step for integrating all the layers together, the low heat transmittance to the inner polymer sheet creates uneven temperature distribution between the inner polymer sheet and the outer polymer sheets, which results in the formation of conductive polymer sheets of uneven thickness.

Also in the present embodiment, a laminated body may be formed using unpatterned metal foils for the outermost layers, while other foils are those patterned by die pressing, integrating these metal foils and conductive polymer sheets together by heat pressing, and then patterning the outermost metal foils using the photolithography and etching process.

A chip PTC thermistor of the same configuration may be produced from the laminated body thus produced, by following the same process steps as those in the first embodiment.

A chip PTC thermistor containing the five or more odd number layers of the conductive polymer is obtainable, by repeating the cycle of stacking and heat-pressing of additional conductive polymer sheets and additional patterned electrodes on the outer surfaces of the second sheet. Also in this example, the outermost layers may be formed of unpatterned metal foils, and patterning the foils in a later stage by etching.

Fourth Embodiment

Figure 11:
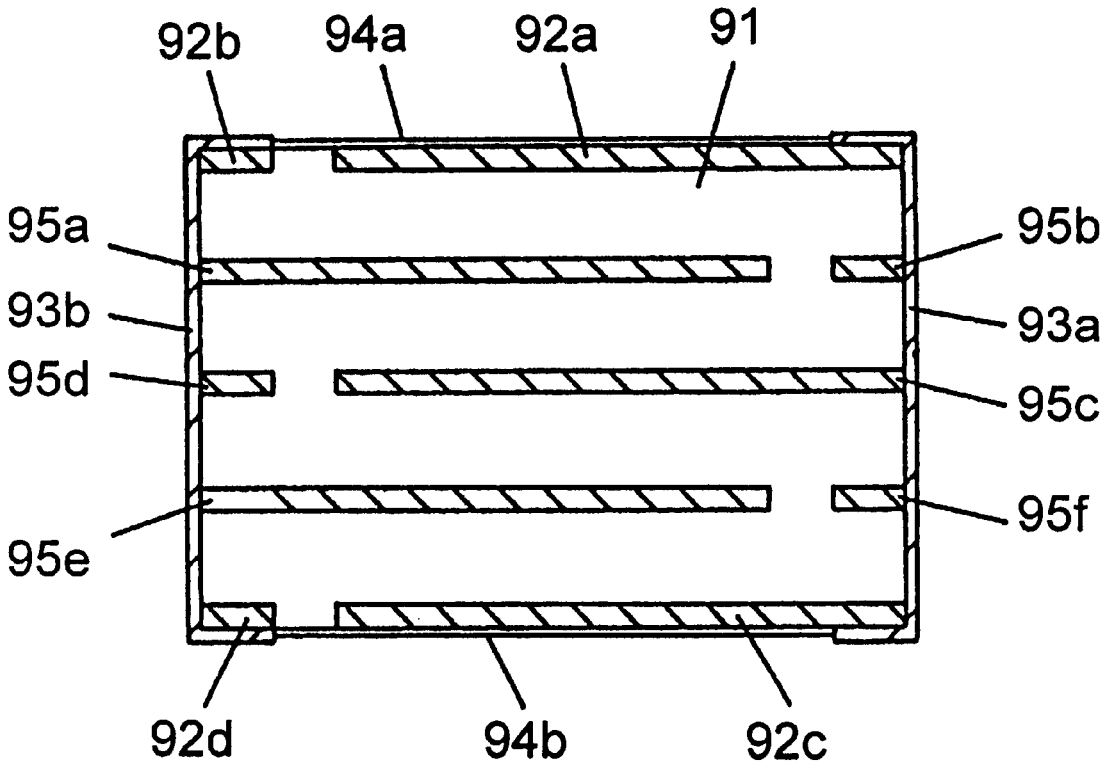
FIG. 11 is a sectional view of a chip PTC thermistor in accordance with a fourth exemplary embodiment of the present invention.

FIG. 11 is a sectional view of a chip PTC thermistor in a fourth exemplary embodiment of the present invention.

In FIG. 11, a cuboidal form conductive polymer 91 having the PTC characteristics is made of a mixed compound of high density polyethylene, i.e. a crystalline polymer, and carbon black, i.e. conductive particles.

First main electrode 92*a* is formed on a first surface of the conductive polymer 91. First sub-electrode 92*b* is disposed on the same surface as the first main electrode 92*a*, yet is independent from said first main electrode 92*a*.

Second main electrode 92*c* is formed on a second surface, which is opposite the first surface of the conductive polymer 91. Second sub-electrode 92*d* is disposed on the same surface as the second main electrode 92*c*, yet is independent from the second main electrode 92*c*.

Each of these main and sub-electrodes is made of electrolytic copper foil.

First side electrode 93*a* is formed by nickel plating covering the entire surface of one of the side ends of the conductive polymer 91, and is electrically connected with the first main electrode 92*a* and the second main electrode 92*c*.

Second side electrode 93*b* is formed by nickel plating covering the entire surface of the other side end opposite the first side electrode 93*a* of the conductive polymer 91, and is electrically connected with the first sub-electrode 92*b* and the second sub-electrode 92*d*. First and second protective coating layers 94*a*, 94*b* are made of an epoxy-modified acrylic resin.

First inner main electrode 95*a* is disposed within the conductive polymer 91, in parallel with the first main electrode 92*a* and the second main electrode 92*c*, and is electrically connected with the second side electrode 93*b*. First inner sub-electrode 95*b* is disposed at the same plane as the first inner main electrode 95*a*, yet is independent from the first inner main electrode 95*a*, and is electrically connected with the first side electrode 93*a*.

Second inner main electrode 95*c* is disposed within the conductive polymer 91, in parallel with the first main electrode 92*a* and the second main electrode 92*c*, and is electrically connected with the first side electrode 93*a*. Second inner sub-electrode 95*d* is disposed at the same plane as the second inner main electrode 95*c*, yet is independent from the second inner main electrode 95*c*, and is electrically connected with the second side electrode 93*b*.

Third inner main electrode 95*e* is disposed within the conductive polymer 91, in parallel with the first main electrode 92*a* and the second main electrode 92*c*, and is electrically connected with the second side electrode 93*b*. Third inner sub-electrode 95*f* is disposed at the same plane as the third inner main electrode 95*e*, yet is independent from the third inner main electrode 95*e*, and is electrically connected with the first side electrode 93*a*.

A method of manufacturing the chip PTC thermistor in a fourth exemplary embodiment is described next with reference to the drawings.

FIGS. 12A–12C and FIGS. 13A–13C illustrate a method of manufacturing the chip thermistor having four conductive polymer layers.

Figure 12A:
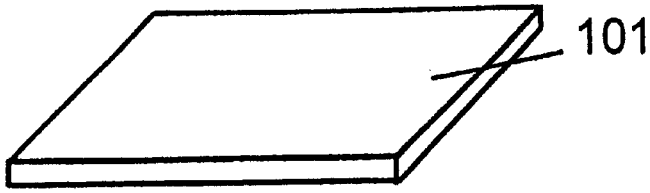
FIGS. 12A–12C illustrate a process for manufacturing the chip PTC thermistor of the fourth embodiment.
Figure 12B:
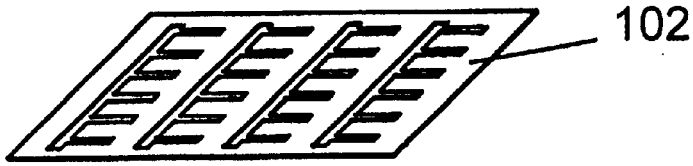

In the same way as in the first embodiment, a conductive polymer sheet 101, shown in FIG. 12A, is provided. An electrolytic copper foil is patterned by die press to provide electrode 102 as shown in FIG. 12B. Like the chip thermistor having two conductive polymer layers, thickness of the electrolytic copper foil for the inner electrode should be not less than 35 $\mu$m, preferably thicker than 70 $\mu$m, so it is not broken by expansion of the conductive polymer during formation of a laminated body by heat pressing.

Figure 12C:
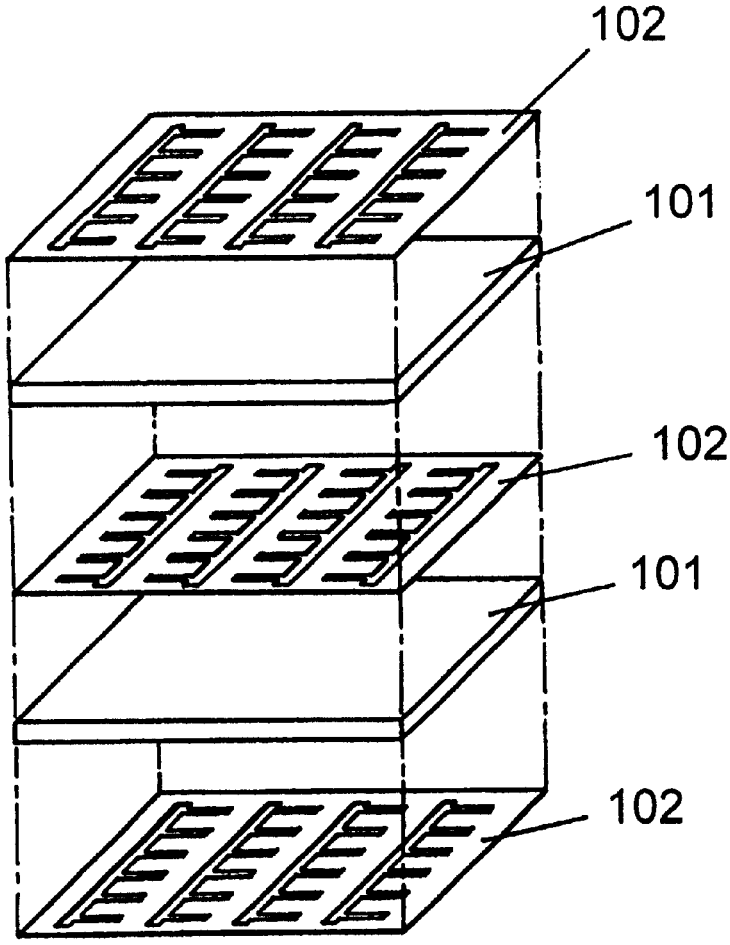

Next, as shown in FIG. 12C, three sheets of the electrode 102 and two sheets of the conductive polymer sheet 101 are stacked alternately to be integrated by heat pressing into a first sheet 103, shown in FIG. 13(*a*), with the electrode 102 on the outermost surface.

Figure 13A:
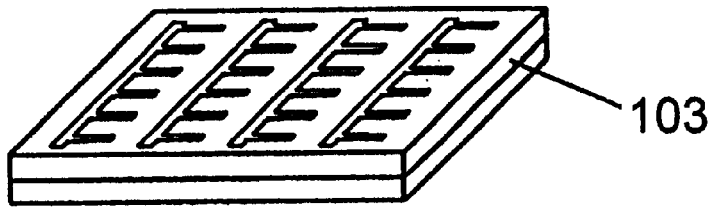
FIGS. 13A–13C illustrate a process for manufacturing the chip PTC thermistor of the fourth embodiment
Figure 13B:
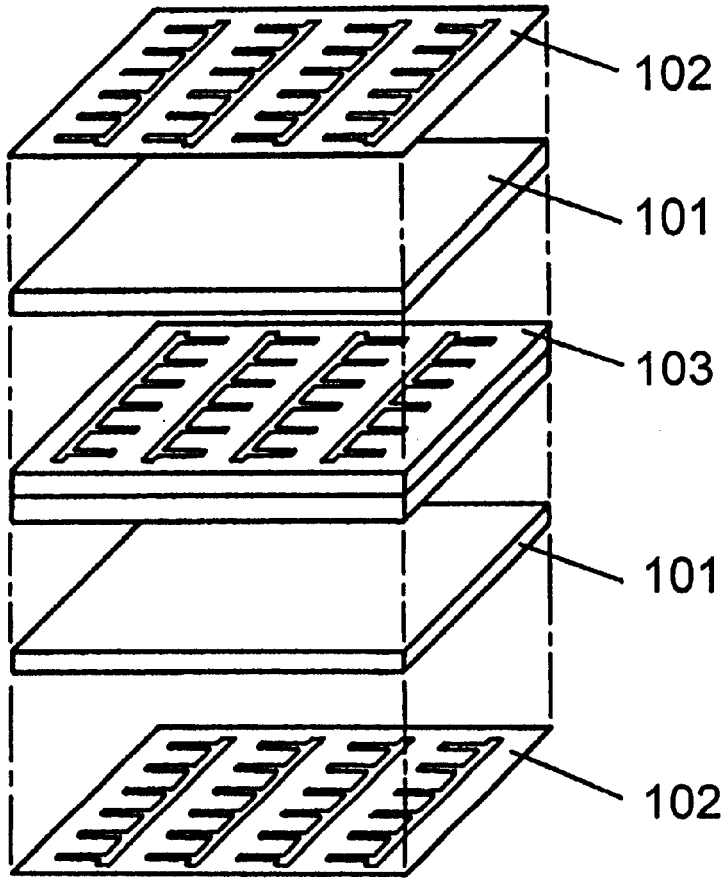
Figure 13C:
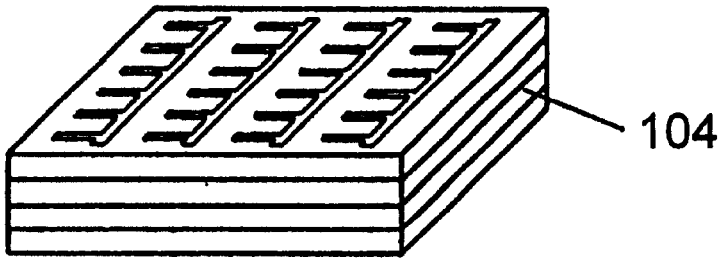
Figure 14A:
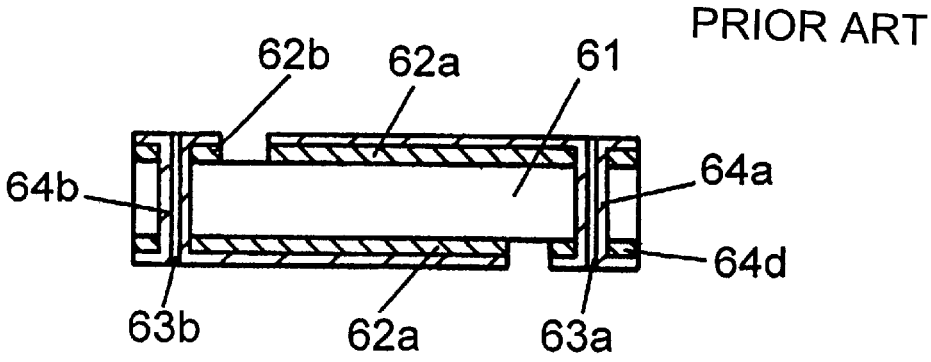
FIG. 14A is a sectional view of a prior art chip PTC thermistor.
Figure 14B:
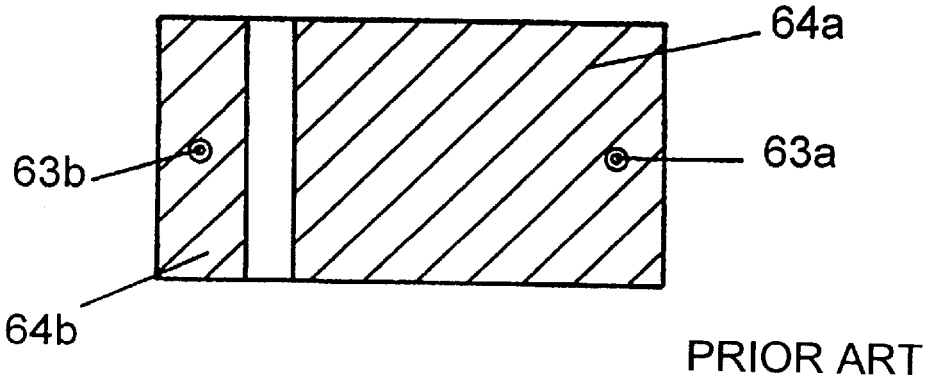
FIG. 14B is a plan view of the prior art chip PTC thermistor.
Figure 15A:
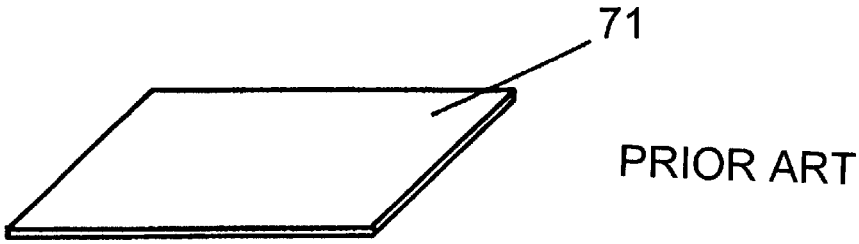
FIGS. 15A–15D illustrate a process for manufacturing a conventional chip PTC thermistor.
Figure 15B:
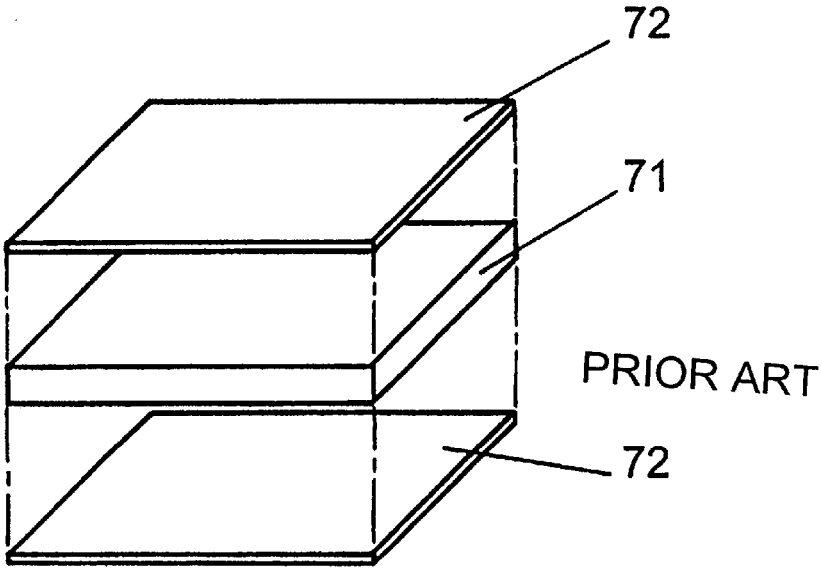
Figure 15C:
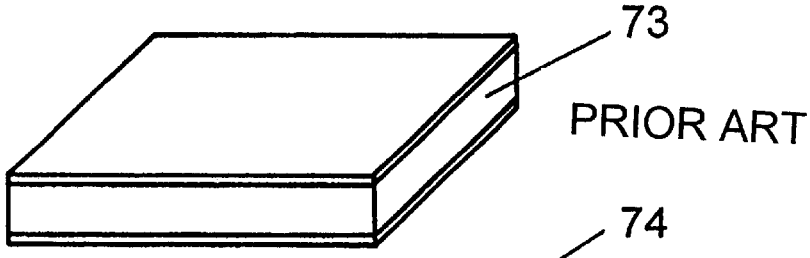
Figure 15D:
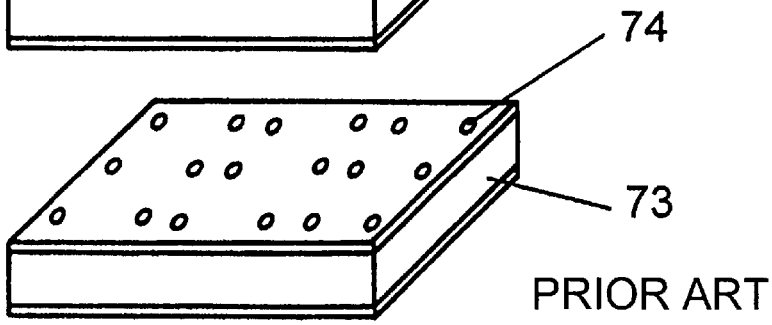
Figure 16A:
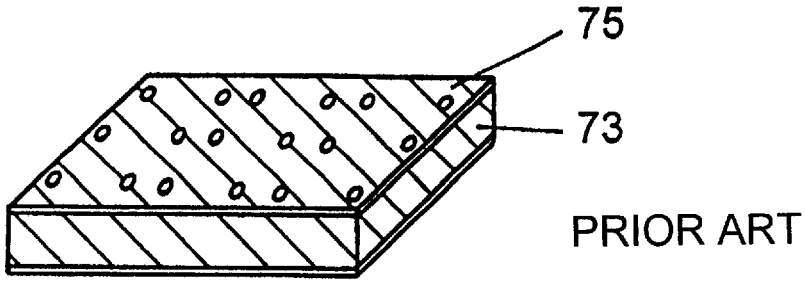
FIGS. 16A–16C illustrate a process for manufacturing a prior art chip PTC thermistor.
Figure 16B:
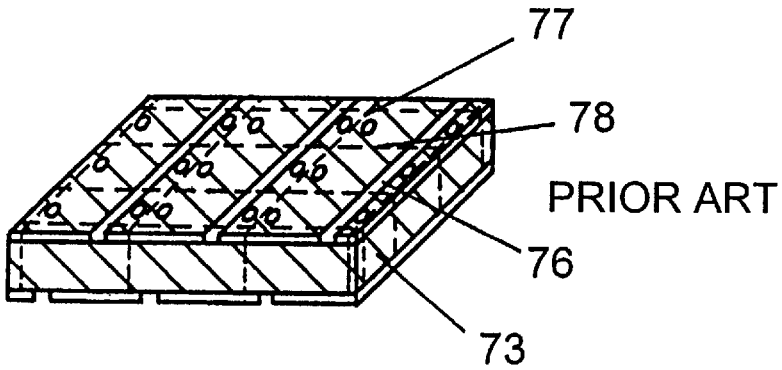
Figure 16C:
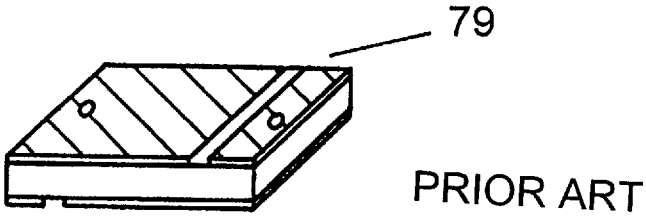
Figure 17A:
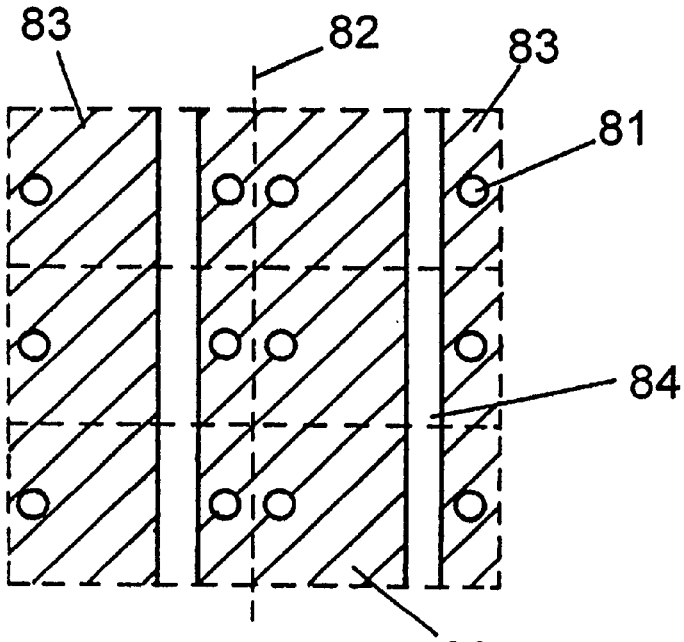
FIG. 17A PRIOR ART
FIGS. 17A–17C illustrate location of the through holes relative to cut line, in a prior art chip PTC thermistor.
Figure 17B:
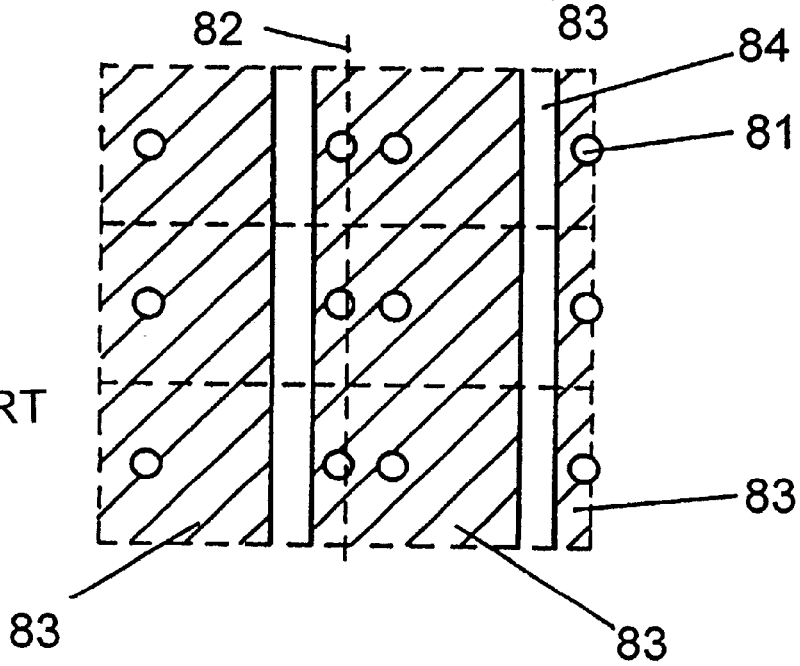
FIG. 17B PRIOR ART
Figure 17C:
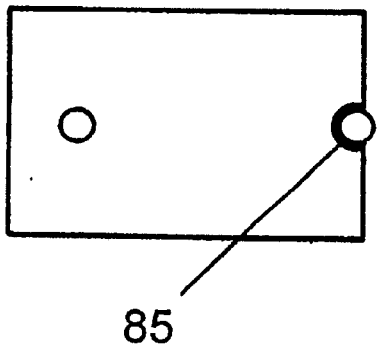
FIG. 17C PRIOR ART

And then, as shown in FIG. 13B, the first sheet 103 is sandwiched from the top and the bottom by two conductive polymer sheets 101 and two electrodes 102, so that respective electrodes 102 are placed on the outermost surfaces, which are heat pressed to be integrated into a second sheet 104 of FIG. 13C.

Thereafter, the same manufacturing process steps as in the first embodiment are followed to obtain the chip PTC thermistor having four conductive polymer layers. Also in the present embodiment, a laminated body may be formed using unpatterned metal foils for the outermost layers, while other foils are those patterned by die pressing, integrating these metal foils and conductive polymer sheets together by heat pressing, and then patterning the outermost metal foils using the photolithography and etching process. Chip PTC thermistors of the same configuration may be obtained from the laminated body thus produced, by following the same process steps as those of the first embodiment.

A chip PTC thermistor containing the six or more even numbered conductive polymer layers is obtainable, by repeating the cycle of stacking and heat-pressing of additional conductive polymer sheets and additional patterned electrodes on the outer surfaces of the second sheet. Also in this embodiment, the outermost layers may be formed of unpatterned metal foils, and patterning the foils in a later stage by etching.

Numbers of layers of the conductive polymer may be increased through the processes as described above. However, the stress due to repetitive expansion and shrinkage of the conductive polymer caused by exposure to an overcurrent also adds up along with the increasing numbers of layers. So, it is important to address the problem of reliability of the coupling between the side electrodes and the main electrodes.

In the chip thermistor in accordance with exemplary embodiments of the present invention, however, side electrodes are provided covering the entire surface of the side end. With such a structure of the present invention, the stress is well dispersed and the reliability in the coupling is sufficiently assured despite the increased number of layers stacked.

Also, the inner sub-electrode is effective to prevent increase of the amount of expansion of the conductive polymer sheet, because it prevents increase in the total thickness of the conductive polymer sheet at the vicinity of side electrode.

Thus the stress caused by the expansion and shrinkage of the conductive polymer sheet affecting the side electrode can be alleviated, and the reliability is further improved.

The use of nickel, as exhibited in the present invention, for the side electrode has been verified to be more effective for improving the above reliability, as compared with side electrode of copper, copper alloy, and the like.

Comparing the chip thermistor having side electrode formed of nickel plated layer in accordance with the manufacturing method of the first embodiment of the present invention is prepared. And, those having copper plated side electrodes are prepared under the following conditions.

A 20 $\mu$m thick copper layer is formed by plating on the side surface of a strip-shaped sheet provided through the process of embodiment 1 in the copper sulfate plating bath for about 60 minutes at a current density of about 1.5 A/dm$^2$, and then the strip-shaped sheet was divided into pieces.

To confirm the reliability of the side electrodes against heat cycle, 30 pieces each of the chip PTC thermistor with the side electrodes of nickel plated layer and those with the side electrodes of copper plated layer were soldered on printed circuit board for cycle testing.

In the test, a 12 V DC power is connected, and an overcurrent of 40 A is supplied for operating (trip) the conductive polymer; the current supply continues for one minute, and then stops for 5 minutes. After 100 cycles, 200 cycles, and 1,000 cycles of the trip cycle test, 10 pieces are sampled from each type, and observed by cross-sectional observation for the presence of any cracks in the side electrode layer. No cracks were observed after the 1,000 cycles among samples having the side electrode layers formed by nickel plating. However, in all the 10 samples among 10 of the thermistor having copper side electrode layer, cracks were found at the junction corner between the side electrode and the upper electrode, before end of the 100 cycles.

With the PTC thermistor chips in the exemplary first embodiment of the present invention, which comprises a cuboidal form conductive polymer 11 having the PTC characteristics, a first main electrode 12*a* disposed on a first surface of the conductive polymer 11, a first sub-electrode 12*b* disposed on the same surface as the first main electrode 12*a*, yet being independent from the first main electrode 12*a*, a second main electrode 12*c* disposed on a second surface, which is opposite the first surface of the conductive polymer 11, a second sub-electrode 12*d* disposed on the same surface as the second main electrode 12*c*, yet being independent from the second main electrode 12*c*, a first side electrode 13*a* covering at least the entire surface of one of the side ends of the conductive polymer 11, which side electrode is electrically connected with the first main electrode 12*a* and the second sub-electrode 12*d*, and a second side electrode 13*b* covering at least the entire surface of the other side end opposing to the first side electrode 13*a* of the conductive polymer 11, which side electrode is electrically connected with the first sub-electrode 12*b* and the second main electrode 12*c*, the solder fillet is formed at the sides of a chip thermistor mounted on a printed circuit board because the side electrodes 13*a*, 13*b* have been provided covering at least the entire surface of two side end surfaces of the conductive polymer 11. As a result, the soldered portions can be easily inspected visually. Furthermore, the chip thermistor of the present invention can be used in the flow soldering process.

With the chip PTC thermistors in the exemplary second and fourth embodiments of the present invention, which comprise cuboidal form conductive polymers 41, 91 having the PTC characteristics, first main electrodes 42*a*, 92*a* formed on the first surface of the conductive polymers 41, 91, first sub-electrodes 42*b*, 92*b* disposed on the same surface as the first main electrodes 42*a*, 92*a*, yet being independent from the first main electrodes 42*a*, 92*a*, second main electrodes 42*c*, 92*c* formed on the second surface, which is opposite the first surface of the conductive polymers 41, 91, second sub-electrodes 42*d*, 92*d* disposed on the same surface as the second main electrodes 42*c*, 92*c*, yet being independent from the second main electrodes 42*c*, 92*c*, first side electrodes 43*a*, 93*a* covering at least the entire surface of one of the side ends of the conductive polymer 41, 91, which side electrodes are electrically connected with the first main electrodes 42*a*, 92*a* and the second main electrodes 42*c*, 92*c*, second side electrodes 43*b*, 93*b* covering at least the entire surface of the other side end opposite the first side electrodes 43*a*, 93*a* of the conductive polymers 41, 91, which side electrode being electrically connected with the first sub-electrodes 42*b*, 92*b* and the second sub-electrodes 42*d*, 92*d*, odd numbered inner main electrodes 45*a*, 95*a*, 95*c*, 95*e* disposed within the conductive polymer 41, 91, in parallel with the first main electrodes 42*a*, 92*a* and the second main electrodes 42*c*, 92*c*, odd numbered inner sub-electrodes 45*b*, 95*b*, 95*d*, 95*f* disposed at the same plane as the inner main electrodes 45*a*, 95*a*, 95*c*, 95*e* yet being independent from the inner main electrodes 45*a*, 95*a*, 95*c*, 95*e*, the inner main electrode 45*a*, 95*a*, 95*e* immediately opposite the first main electrodes 42*a*, 92*a* being electrically connected with the second side electrodes 43*b*, 93*b*, the inner sub-electrodes 45*b*, 95*b* disposed at the same plane as the inner main electrodes 45*a*, 95*a* immediately opposite the first main electrodes 42*a*, 92*a* being electrically connected with the first side electrodes 43*a*, 93*a*, the inner main electrodes 95*c* and 95*e* as well as inner sub-electrodes 95*f* and 95*d* disposed next to each other being electrically connected alternately with the first side electrode 93*a* and the second side electrode 93*b*, respectively, the resistance of a chip thermistor has been reduced without making the area of main electrodes greater, because the overall resistance of a chip thermistor is represented by a resistance formed of two parallel-connected resistances, in an exemplary case where there is one inner main electrode, of the conductive polymer disposed between first main electrode and inner main electrode and the conductive polymer between second main electrode and inner main electrode. This structure enables lowering the resistance of a chip thermistor without increasing the overall dimensions.

With the chip PTC thermistor in the exemplary third embodiment of the present invention, which comprises a cuboidal form conductive polymer 1 having the PTC characteristics, a first main electrode 2*a* formed on a first surface of the conductive polymer 1, a first sub-electrode 2*b* disposed on the same surface as the first main electrode 2*a*, yet being independent from the first main electrode 2*a*, a second main electrode 2*c* formed on a second surface, which is opposite the first surface of the conductive polymer 1, a second sub-electrode 2*d* disposed on the same surface as the second main electrode 2*c*, yet being independent from the second main electrode 2*c*, a first side electrode 3*a* covering at least the entire surface of one of the side ends of the conductive polymer 1, which side electrode is electrically connected with the first main electrode 2*a* and the second sub-electrode 2*d*, a second side electrode 3*b* covering at least the entire surface of the other side end opposite the first side electrode 3*a* of the conductive polymer 1, which side electrode is electrically connected with the first sub-electrode 2*b* and the second main electrode 2*c*, even numbered inner main electrodes 5*a*, 5*c* disposed within the conductive polymer 1, in parallel with the first main electrode 2*a* and the second main electrode 2*c*, and even numbered inner sub-electrodes 5*b*, 5*d* disposed at the same plane as the inner main electrode 5*a*, 5*c*, yet being independent from the inner main electrode 5*a*, 5*c*, the inner main electrode 5*a* immediately opposite the first main electrode 2*a* being electrically connected with the second side electrode 3*b*, the inner sub-electrode 5*b* disposed on the same plane as the inner main electrode 5*a* immediately opposite the first main electrode 2*a* being electrically connected with the first side electrode 3*a*, the inner main electrode 5*c* and inner sub-electrode 5*d* disposed next to each other being electrically connected with the first side electrode 3*a* and the second side electrode 3*b*, respectively, the overall resistance of a chip thermistor has been reduced without making the area of main electrodes greater, because the overall resistance of a chip thermistor is represented by a resistance formed of parallel-connected resistances, in an exemplary case where there are two inner main electrodes, of the conductive polymer disposed between first main electrode and first inner main electrode, the conductive polymer between second main electrode and second inner main electrode, and the conductive polymer between first inner main electrode and second inner main electrode. This structure enables lowering the resistance of a chip thermistor without increasing the overall dimensions.

Furthermore, since the side electrodes in the first through the fourth embodiments of the present invention have been formed of nickel, or nickel alloy, which has a relatively strong withstanding capability against repetitive stress, which stress is caused by the repetitive expansion and shrinkage of the conductive polymer, and tends to concentrate at the junction corner between the side electrode and the main electrode, the reliability of coupling of the side electrodes with the first and the second main electrodes has been improved.

Under a method of manufacturing the chip PTC thermistor in the exemplary first embodiment of the present invention, which comprises the steps of sandwiching conductive polymer having the PTC characteristics from the top and the bottom with patterned metal foil and integrating these into a sheet 23 by heat pressing, providing the integrated sheet 23 with openings 24 (slits), providing a protective coating 25 on the top and the bottom surfaces of the sheet 23 having the openings 24, forming side electrodes 13*a*, 13*b* in the sheet 23 that has been provided with the protective coating 25 and the openings 24, and dividing the sheet 23 having the side electrodes 13*a*, 13*b* and the openings 24 into piece chip thermistor, the shape of the end face of the opening 24, which shape is formed of straight lines, will have only small variation even if there is a slight displacement in the location of the opening 24 relative to the pattern of metal foil due to a tolerance in the processing accuracy during formation of the opening 24.

Accordingly, the side electrodes 13*a*, 13*b* formed on the side face of the opening 24 by plating or the like method are provided with a certain stable junction area with the first and the second main electrodes 12*a*, 12*c*, so the strength of coupling between the side electrodes 13*a*, 13*b* and the first and second electrodes 12*a*, 12*c* against the stress due to expansion and shrinkage of the conductive polymer will have only small variation.

Under another method for manufacturing the chip PTC thermistor in the exemplary first embodiment of the present invention, which comprises the steps of sandwiching conductive polymer having the PTC characteristics from the top and the bottom with metal foil and integrating these into a sheet 23 by heat pressing, patterning the metal foil at the top and the bottom of the integrated sheet 23 by etching, providing the integrated sheet 23 with openings 24 (slits), providing a protective coating 25 on the top and the bottom surfaces of the sheet 23 having the openings 24, forming side electrodes 13*a*, 13*b* in the sheet 23 having the protective coating 25 and the openings 24, and dividing the sheet 23 having side electrodes 13*a*, 13*b* and the openings 24 into piece chip thermistors, the shape of the end face of the opening 24, which shape is formed of straight lines, will have only small variation even if there is a slight displacement in the location of the opening 24 due to a tolerance in the processing accuracy during formation of the opening 24.

Accordingly, the side electrodes 13*a*, 13*b* formed on the side face of the opening 24 by plating or the like method are provided with a certain stable junction area with the first and the second main electrodes 12*a*, 12*c*, so the strength of coupling between the side electrode 13*a*, 13*b* and the first and second electrodes 12*a*, 12*c* against the stress due to expansion and shrinkage of the conductive polymer will have only small variation.

Furthermore, because the pattern is formed on the metal foil by etching after the heat-pressing process, the pattern is disposed at highly accurate locations on the top and the bottom metal foils, namely, the overlapping area formed of the first main electrode 12*a* and the second main electrode 12*c*, which overlapping area is relevant to resistance of a chip thermistor, will have only small degradation. This contributes to a reduced degradation in the resistance among the thermistor chips.

Under a method of manufacturing the chip PTC thermistor in the exemplary second embodiment of the present invention, which comprises the steps of forming an integrated sheet 53 by sandwiching a patterned metal foil from the top and the bottom surfaces with conductive polymer having the PTC characteristics, further stacking patterned metal foil on both surfaces and integrating these into sheet 53 by heat-pressing, providing the integrated sheet 53 with openings, forming a protective coating on the top and the bottom surfaces of sheet 53 having the openings, forming side electrodes 43*a*, 43*b* in the sheet 53 having the protective coating and the openings, and dividing the sheet 53 having side electrodes 43*a*, 43*b* and the openings into piece chip thermistors, a laminated body containing two sheets of the conductive polymer and three sheets of patterned metal foil alternately stacked therein can be provided through one heat-pressing operation.

Under another method for manufacturing the chip PTC thermistor in the exemplary second embodiment of the present invention, which comprises the steps of forming an integrated sheet 53 by sandwiching a patterned metal foil from the top and the bottom surfaces with conductive polymer having the PTC characteristics, further stacking metal foil on both surfaces and integrating these into sheet 53 by heat-pressing, patterning the metal foils on the top and the bottom surfaces of the integrated sheet 53 by etching, providing the integrated sheet 53 with openings, forming a protective coating on the top and the bottom surfaces of the sheet 53 having the openings, forming side electrodes 43*a*, 43*b* in the sheet 53 having the protective coating and the openings, and dividing the sheet 53 having side electrodes 43*a*, 43*b* and the openings into piece chip thermistors, the pattern is disposed at highly accurate locations on the outermost metal foils, since the pattern is formed by etching the outermost metal foils after a laminated body containing two sheets of conductive polymer, one sheet of patterned metal foil and two sheets of the outermost metal foil alternately stacked therein is formed by one heat-pressing operation. The overlapping area formed of the first main electrode 42*a*, the second main electrode 42*c* and the inner main electrode 45*a*, which overlapping area is relevant to resistance of a chip thermistor, will have only small variation. This contributes to reduced variation in the resistance among the chip thermistors.

Under a method for manufacturing the chip PTC thermistor in the exemplary third embodiment of the present invention, which comprises the steps of forming a first sheet 33 by sandwiching the conductive polymer having the PTC characteristics from the top and the bottom with patterned metal foil and integrating these by heat pressing, forming a second sheet 34 by sandwiching the first sheet 33 from the top and the bottom with conductive polymer having the PTC characteristics, further stacking patterned metal foil on the top and the bottom surfaces of the conductive polymer having the PTC characteristics and integrating these into a laminated body by heat pressing, the cycle of heat pressing for integration may be repeated twice or for more cycles, providing the integrated second sheet 34 with openings, providing protective coating on the top and the bottom surfaces of the sheet 34 having the openings, forming side electrodes 3*a*, 3*b* in the second sheet 34 having the protective coating and the openings, and dividing the second sheet 34 having the side electrodes 3*a*, 3*b* and the openings into piece chip thermistors, the thicknesses of the conductive polymer layers will have only small variation among those located in the middle strata of the laminated body and those in the outer strata.

The reason for the small variation of the layer thickness is that a laminated body has been formed starting from the inner portion by repeating stacking and heat-pressing step after step towards outer strata; forming a laminated body by first integrating one sheet of the conductive polymer and two sheets of patterned metal foil into one sheet formed by heat pressing, and then repeating the cycle of further stacking the conductive polymer for two or more even numbered layers and patterned metal foil for two or more even numbered layers to be integrated by heat pressing, eventually forming a laminated body containing the conductive polymer for three or more odd numbered layers and patterned metal sheets alternately therein.

Under another method for manufacturing the PTC thermistor chips in the exemplary third embodiment of the present invention, which comprises the steps of forming a first sheet 33 by sandwiching the conductive polymer having the PTC characteristics from the top and the bottom with patterned metal foil and integrating these by heat pressing, forming a second sheet 34 by sandwiching the integrated first sheet 33 from the top and the bottom with conductive polymer having the PTC characteristics and further stacking metal foil on the top and the bottom surfaces of the conductive polymer having the PTC characteristics and integrating these into a laminated body by heat pressing, patterning the metal foil on both surfaces of the integrated second sheet 34 by etching, providing said integrated second sheet 34 with openings, providing a protective coating on the top and the bottom surfaces of the second sheet 34 having the openings, forming side electrodes 3*a*, 3*b* in the second sheet 34 having the protective coating and the openings, and dividing the second sheet 34 having side electrodes 3*a*, 3*b* and the openings into piece chip thermistors, the pattern is disposed at highly accurate locations on the outermost metal foils, since the pattern is formed by etching the outermost metal foils after a laminated body containing one sheet of conductive polymer and two sheets of patterned metal foil are integrated into one sheet formed by heat pressing, further stacking thereon the conductive polymer for two sheets and unpatterned metal foil for the outermost layers for two sheets to be integrated by heat pressing. The overlapping area formed of the first main electrode 2*a*, the second main electrode 2*c* and the inner main electrode 5*a*, which overlapping area is relevant to resistance of a chip thermistor, will have only small variation. This contributes to reduced variation in the resistance among the chip thermistors.

Under a still another method for manufacturing the PTC thermistor chips in the exemplary third embodiment of the present invention, which comprises the steps of forming a first sheet 33 by sandwiching the conductive polymer having the PTC characteristics from the top and the bottom with patterned metal foils and integrating these by heat pressing, forming a second sheet 34 by sandwiching the integrated first sheet 33 from the top and the bottom with conductive polymer having the PTC characteristics, further stacking patterned metal foil on the top and the bottom surfaces of the conductive polymer having the PTC characteristics and integrating these into a laminated body by heat pressing, the cycle of heat pressing for integration may be repeated twice or for more cycles, forming a third sheet by sandwiching the integrated second sheet 34 from the top and the bottom with the conductive polymer having the PTC characteristics, further stacking metal foil on the top and the bottom surfaces of the conductive polymer having the PTC characteristics and integrating these into a laminated body by heat pressing, patterning the metal foil on the top and the bottom surfaces of said integrated third sheet by etching, providing said integrated third sheet with openings, providing a protective coating on the top and the bottom surfaces of the integrated third sheet having the openings, forming side electrodes 3*a*, 3*b* in the third sheet having the protective coating and the openings, and dividing the third sheet having said side electrodes 3*a*, 3*b* and the openings into piece chip thermistors, the pattern is disposed at highly accurate locations on the outermost metal foils, since the pattern is formed by etching the outermost metal foils after a laminated body containing one sheet of conductive polymer and two sheets of patterned metal foil are integrated into one sheet formed by heat pressing, further stacking thereon the conductive polymer for two or more even numbered layers and patterned metal foil for two or more even numbered layers alternately to be integrated through repeated heat-pressing cycles, and providing unpatterned metal foil for the outermost layers to be integrated by heat pressing, eventually forming a laminated body containing the conductive polymer for five or more odd numbered layers, patterned metal foils and the unpatterned metal foils for the outermost layers disposed alternately. The overlapping area formed of the first main electrode 2*a*, the second main electrode 2*c* and the inner main electrode 5*a*, which overlapping area is relevant to resistance of a chip thermistor, will have only small variation. This contributes to reduced variation in the resistance among the chip thermistors.

Under a method for manufacturing the chip PTC thermistor in the exemplary fourth embodiment of the present invention, which comprises the steps of forming a first sheet 103 by sandwiching a patterned metal foil from the top and the bottom with conductive polymer having the PTC characteristics and further stacking patterned metal foil on the top and the bottom surfaces, and integrating these into a laminated body by heat pressing, forming a second sheet 104 by sandwiching the integrated first sheet 103 from the top and the bottom with conductive polymer having the PTC characteristics and further stacking patterned metal foil on the top and the bottom surfaces of the conductive polymer having the PTC characteristics, and integrating these into a laminated body by heat pressing, the cycle of stacking and heat-pressing for integration may be repeated twice or for more cycles, providing the integrated second sheet 104 with openings, forming a protective coating on the top and the bottom surfaces of the second sheet 104 having the openings, forming side electrodes 93*a*, 93*b* in the second sheet 104 having the protective coating and the openings, and dividing the second sheet 104 having the side electrodes 93*a*, 93*b* and the openings into piece chips, the thickness of the conductive polymer layers will have only small variation among those located in the middle strata of the laminated body and those in the outer strata. The reason for the small variation of the layer thickness is that a laminated body has been formed starting from the inner strata by repeating stacking and heat-pressing step after step towards outer strata, by first integrating two sheets of conductive polymer and three sheets of patterned metal foil into one sheet formed by heat pressing, and then further stacking the conductive polymer for two or more even numbered layers and the patterned metal foil for two or more even numbered layers alternately to be integrated through repeated cycles of the heat pressing process, eventually forming a laminated body containing the conductive polymer for four or more even numbered layers and the patterned metal foils alternately therein.

Under another method for manufacturing the chip PTC thermistor in the exemplary fourth embodiment of the present invention, which comprises the steps of forming a first sheet 103 by sandwiching a patterned metal foil from the top and the bottom with conductive polymer having the PTC characteristics, further stacking patterned metal foil on the top and the bottom surfaces and integrating these by heat pressing into a laminated body, forming a second sheet 104 by sandwiching the integrated first sheet 103 from the top and the bottom with conductive polymer having the PTC characteristics, further stacking metal foil on the top and the bottom surfaces of the conductive polymer having the PTC characteristics, and integrating these into a laminated body by heat pressing, patterning the metal foil provided on the top and the bottom surfaces of the integrated second sheet 104 by etching, providing the integrated second sheet 104 with openings, forming a protective coating on the top and the bottom surfaces of the second sheet 104 having the openings, forming side electrodes 93*a*, 93*b* in the second sheet 104 having the protective coating and the openings, and dividing the second sheet 104 having side electrodes 93*a*, 93*b* and the openings into piece chip thermistors, the pattern is disposed at highly accurate locations on the outermost metal foils, since the pattern is formed by etching the outermost metal foils after a laminated body containing two sheets of conductive polymer and three sheets of patterned metal foil are integrated into one sheet formed by heat pressing, further stacking thereon the conductive polymer for two layers and unpatterned metal foil for the outermost layer for two layers alternately to be integrated into a laminated body by heat pressing. The overlapping area formed of the first main electrode 92*a*, the second main electrode 92*c* and the inner main electrodes 95*a*, 95*c*, 95*e*, which overlapping area is relevant to resistance of a chip thermistor, will have only small variation. This contributes to reduced variation in the resistance among the chip thermistors.

Under a still other method for manufacturing the PTC thermistor chips in the exemplary fourth embodiment of the present invention, which comprises the steps of forming a first sheet 103 by sandwiching a patterned metal foil from the top and the bottom with conductive polymer having the PTC characteristics, further stacking patterned metal foil on both surfaces and integrating these into a laminated body by press heating, forming a second sheet 104 by sandwiching the integrated first sheet 103 from the top and the bottom with conductive polymer having the PTC characteristics, further stacking patterned metal foil on the both surfaces and integrating these into a laminated body by heat pressing, the cycle of heat pressing for integration may be repeated twice or for more cycles, forming a third sheet by sandwiching the integrated second sheet 104 from the top and the bottom with conductive polymer having the PTC characteristics, further stacking metal foil on the both surfaces and integrating these into a laminated body by heat pressing, patterning the metal foil on both surfaces of the integrated third sheet by etching, providing the integrated third sheet with openings, providing a protective coating on the top and the bottom surfaces of the third sheet having the openings, forming side electrodes 93*a*, 93*b* in the third sheet having the protective coating and the openings, and dividing the third sheet having the side electrodes 93*a*, 93*b* and the openings into piece chip thermistors, the pattern is disposed at highly accurate locations on the outermost metal foils, since the pattern is formed by etching the outermost metal foils after a laminated body containing two sheets of conductive polymer and three sheets of patterned metal foil are integrated into one sheet formed by heat pressing, further stacking thereon the conductive polymer for two or more layers in counts and patterned metal foil for two or more even numbered layers alternately to be integrated into one sheet formed through repeated cycles of the heat-pressing process, further providing unpatterned metal foil for the outermost layers to be integrated, eventually forming a laminated body containing the conductive polymer for six or more even numbered layers and the patterned metal foils alternately therein. The overlapping area formed of the first main electrode 92*a*, the second main electrode 92*c* and the inner main electrodes 95*a*, 95*c*, 95*e*, which overlapping area is relevant to resistance of a chip thermistor, will have only small variation. This contributes to reduced variation in the resistance among the chip thermistors.

Furthermore, under a method for manufacturing the chip PTC thermistor in the exemplary first embodiment of the present invention, where the opening 24 (slits) is formed in a strip shape, or a comb shape, and the end face of the opening is formed of straight lines; form of the end face of the opening will have little variation even if location of the end face is slightly dislocated relative to the pattern of metal foil due to tolerance in the processing accuracy allowed during formation of the strip shape, or the comb shape. Accordingly, the side electrodes 13*a*, 13*b* formed on the end face by plating or the like method will have a certain stable junction area with the first main electrode 12*a* and the second main electrode 12*c*, so strength in the coupling at the junction between the side electrodes 13*a*, 13*b* and the first main electrode 12*a* and the second main electrode 12*c* against the stress caused by expansion and shrinkage of the conductive polymer will have a smaller variation.

Still further, under a method for manufacturing the chip PTC thermistor in the exemplary first embodiment of the present invention, the metal foil is patterned into a comb shape at the opening 24 (slit). Therefore, in a later process step of dividing into piece chip thermistors, the metal foil is incised at a portion corresponding to the comb tooth. Thus the incised portion is smaller as compared with a metal foil having no comb opening. This reduces the quantity of burr generation with the metal foil at the dividing step, also reduces the exposure of the cut end of metal foil to the side surface of a chip thermistor, which is advantageous in avoiding oxidation of the exposed surface and in preventing the occurrence of short-circuiting by solder when mounting the chip thermistor on a circuit board.

INDUSTRIAL APPLICABILITY

The PTC thermistor chips of the present invention are formed of a cuboidal form conductive polymer having the PTC characteristics, a first main electrode disposed on a first surface of the conductive polymer, a first sub-electrode disposed on the same surface as the main electrode, yet being independent from the first main electrode, a second main electrode disposed on a second surface opposite the first surface of the conductive polymer, a second sub-electrode disposed on the same surface as the second main electrode, yet being independent from said second main electrode, a first side electrode covering at least the entire surface of one of the side surfaces of the conductive polymer, which side electrode is electrically connected with the first main electrode and the second sub-electrode, and a second side electrode covering at least the entire surface of the other side surface opposite the one side surface of the conductive polymer, that side electrode being electrically connected with the first sub-electrode and the second main electrode.

Under the structure as configured above, since the side electrode is provided covering at least the entire side surface of the two side surfaces of the conductive polymer, solder fillet can be formed at the side of the chip thermistor mounted on a printed circuit board. It is an advantage of the chip PTC thermistor of the present invention that the soldered portion can be easily inspected visually after the chip thermistors are mounted on a printed circuit board. Furthermore, the chip PTC thermistor can be used in the flow soldering process.

What is claimed is:

1. A method of manufacturing a chip PTC thermistor comprising:

forming an integrated sheet by sandwiching a conductive polymer having PTC characteristics between metal foils having comb-shaped openings and integrating the polymer and metal foils by heat pressing, said comb shaped openings each comprising (1) a main opening and (2) a plurality of sub-openings formed perpendicular to the main opening, providing through openings in said integrated sheet, said through openings penetrating through a top surface and a bottom surface of said integrated sheet, providing protective coatings on said top surface and said bottom surface of the integrated sheet except an area in a vicinity of the openings, forming an electrode on an inner wall of the through openings and in the vicinity of the through openings, and dividing the sheet having said electrode and said through openings into pieces by cutting along lines of the sub-openings.

2. A method of manufacturing a chip PTC thermistor comprising:

forming an integrated sheet by sandwiching a conductive polymer having PTC characteristics between metal foils and integrating the sheet by heat pressing, patterning the metal foils on the top and a bottom surface of said integrated sheet by etching, to form comb-shaped slits, said comb-shaped slits each comprising (1) a main slit and (2) a plurality of sub-slits perpendicular to the main slits, providing through openings in said integrated sheet, said through openings penetrating through said top surface and said bottom surface of said integrated sheet, providing protective coatings on said top surface and said bottom surface of the integrated sheet except an area in a vicinity of the through openings, forming an electrode on an inner wall of the through openings and in the vicinity of the openings, and dividing integrated sheet into pieces by cutting along lines of the sub-openings.

* * * * *